US009640007B2

(12) United States Patent
Mizuno

(10) Patent No.: US 9,640,007 B2
(45) Date of Patent: May 2, 2017

(54) MEDIUM TRANSACTION DEVICE

(71) Applicant: Oki Electric Industry Co., Ltd., Tokyo (JP)

(72) Inventor: Takayuki Mizuno, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/112,052

(22) PCT Filed: Oct. 7, 2014

(86) PCT No.: PCT/JP2014/076857
§ 371 (c)(1),
(2) Date: Jul. 15, 2016

(87) PCT Pub. No.: WO2015/145832
PCT Pub. Date: Oct. 1, 2015

(65) Prior Publication Data

US 2016/0350995 A1 Dec. 1, 2016

(30) Foreign Application Priority Data

Mar. 27, 2014 (JP) ..... 2014-066786

(51) Int. Cl.
*G07D 7/00* (2016.01)
*G07D 7/20* (2016.01)
*G07F 7/04* (2006.01)

(52) U.S. Cl.
CPC ..... *G07D 7/0006* (2013.01); *G07D 7/004* (2013.01); *G07D 7/20* (2013.01); *G07F 7/04* (2013.01)

(58) Field of Classification Search
CPC ..... G07D 7/00; G07D 7/20; G07D 7/2016; G07D 11/0021; G07D 11/0051;
(Continued)

(56) References Cited

U.S. PATENT DOCUMENTS 6,550,671 B1 * 4/2003 Brown ..... G07D 11/0066 235/379
2008/0219543 A1 * 9/2008 Csulits ..... G07D 7/00 382/135

(Continued)

FOREIGN PATENT DOCUMENTS

JP 07-121753 A 5/1995
JP H07-192161 A 7/1995

(Continued)

*Primary Examiner* — Mark Beauchaine
(74) *Attorney, Agent, or Firm* — Rabin & Berdo, P.C.

(57) ABSTRACT

The precision of detection of abnormal media is increased using a unique identification number. A banknote deposit/withdrawal mechanism of an automated teller machine confirms whether a banknote having the same serial number is among transaction banknotes by comparing each transaction serial number obtained by reading the serial number for each transaction banknote with other transaction serial numbers. Thereby, when counterfeit notes having the same serial number are included among the transaction banknotes, the banknote deposit/withdrawal mechanism cannot determine a banknote as counterfeit in a process of collating the serial numbers with a counterfeit note serial number list, but can determine that a banknote is counterfeit in a collation process between the transaction serial numbers. In this case, the banknote deposit/withdrawal mechanism can prevent counterfeit notes from being transferred to a user by transporting a relevant transaction banknote together with all other transaction banknotes to a reject compartment.

20 Claims, 13 Drawing Sheets

(58) Field of Classification Search
CPC .. G07D 11/0084; G07D 7/0006; G07D 7/004; G07F 7/04
See application file for complete search history.

(56) References Cited

U.S. PATENT DOCUMENTS

| | | | | |
|---|---|---|---|---|
| 2011/0031308 | A1* | 2/2011 | Holland-Letz | B65H 1/025 235/379 |
| 2011/0206265 | A1* | 8/2011 | Numata | G06Q 20/389 382/135 |

FOREIGN PATENT DOCUMENTS

| | | | |
|---|---|---|---|
| JP | H11-45365 | A | 2/1999 |
| JP | 2014-016856 | A | 1/2014 |

* cited by examiner

FIG.5

L1 TRANSACTION SERIAL NUMBER LIST

| ORDER | DENOMINATION | SERIAL NUMBER |
|---|---|---|
| 1 | 10000 | AA111111A |
| 2 | 10000 | BB222222B |
| 3 | 1000 | KK555555K |
| ⋮ | ⋮ | ⋮ |

FIG.10

L2(L2A~L2D) TRANSACTION SERIAL NUMBER LIST

| ORDER | SERIAL NUMBER |
|---|---|
| 1 | AA111111A |
| 2 | BB222222B |
| 3 | KK555555K |
| ⋮ | ⋮ |

MEDIUM TRANSACTION DEVICE

TECHNICAL FIELD

The present invention relates to a medium transaction device, and is suitably applied to, for example, an automated teller machine (ATM) which performs desired transactions by dispatching media such as banknotes requested by a user.

BACKGROUND ART

In ATMs, etc. conventionally used in financial institutions, etc., for example, ATMs for allowing a user to deposit cash such as banknotes or coins and dispensing cash to the user according to content of a transaction with the user have become widespread.

As an ATM, for example, an ATM having a deposit/withdrawal unit for exchanging banknotes with the user, a transport unit for transporting the banknotes, a discrimination unit for discriminating the denomination and genuineness of an inserted banknote, a temporary holding unit for temporarily holding the inserted banknote, a banknote storage compartment for storing banknotes according to denomination, a control unit for overall control, etc. has been proposed.

The ATM sequentially dispatches banknotes based on the denominations and the number of banknotes according to a withdrawal amount from the banknote storage compartment when the start of a withdrawal transaction and the withdrawal amount are indicated by a user in the withdrawal transaction, discriminates the denomination, the transport state, etc. by discriminating the banknotes one by one, and sequentially transports the banknotes capable of being withdrawn to the deposit/withdrawal unit to allow the user to withdraw the banknotes.

At this time, the ATM discriminates whether a banknote dispatched from the banknote storage compartment is a counterfeited banknote (a so-called counterfeit note) by the discrimination unit. Specifically, the discrimination unit determines whether the banknote is a counterfeit banknote by comparing image data obtained by imaging the banknote, a thickness of the banknote, magnetic information, etc. with normal image data, value, etc.

Also, print technology is used in many cases when the counterfeit note is manufactured and a large number of counterfeit notes having the same serial number through printing may be manufactured because an operation of intentionally printing different serial numbers is time-consuming.

Therefore, in some ATMs, in addition to the above-described determination process, there is a process of determining whether each banknote is a counterfeit note by pre-storing a list of serial numbers known as those of counterfeit notes (hereinafter referred to as a counterfeit note serial number list) in a storage unit or the like within a control unit and collating a read serial number with the counterfeit note serial number list (for example, see Patent Literature 1).

CITATION LIST

Patent Literature

Patent Literature 1: JP H7-121753A (FIG. 5)

SUMMARY OF INVENTION

Technical Problem

However, because the serial numbers pre-registered in the counterfeit note serial number list are collated with the read serial number in the ATM of such a configuration, there is a problem in that it is impossible to detect a counterfeit note which is newly counterfeited, but is not registered in the counterfeit note serial number list.

The present invention has been made in consideration of the above problem, and the invention proposes a medium transaction device capable of increasing the precision of detection of abnormal media using a unique identification number.

Solution to Problem

In order to solve the above problem, a medium transaction device according to the present invention includes: a read unit configured to read an identification number from a transaction medium to be transacted between a user and the medium transaction device among media having unique identification numbers; a comparison unit configured to compare a transaction identification number which is the identification number read from the transaction medium by the read unit with the transaction identification number of another transaction medium; and an abnormality handling unit configured to perform a predetermined abnormality handling process when the transaction identification number is the same as the other transaction identification number.

In the present invention, a predetermined abnormality handling process can be performed by determining that a medium is abnormal when an identification number of a transaction medium is the same as another identification number on the basis of the fact that there are no media having the same identification number as each other in nature because a unique identification number is assigned to each medium.

Advantageous Effects of Invention

According to the present invention, a predetermined abnormality handling process can be performed by determining that a medium is abnormal when an identification number of a transaction medium is the same as another identification number. Thus, according to the present invention, a medium transaction device capable of increasing the precision of detection of abnormal media using a unique identification number can be implemented.

BRIEF DESCRIPTION OF DRAWINGS

FIG. 5 is a schematic diagram illustrating a transaction serial number list according to the first embodiment.

FIG. 10 is a schematic diagram illustrating a transaction serial number list according to a sixth embodiment.

DESCRIPTION OF EMBODIMENTS

Hereinafter, modes (hereinafter referred to as embodiments) for carrying out the invention will be described using the drawings.

1. First Embodiment

1-1. Configuration of ATM

Figure 1:
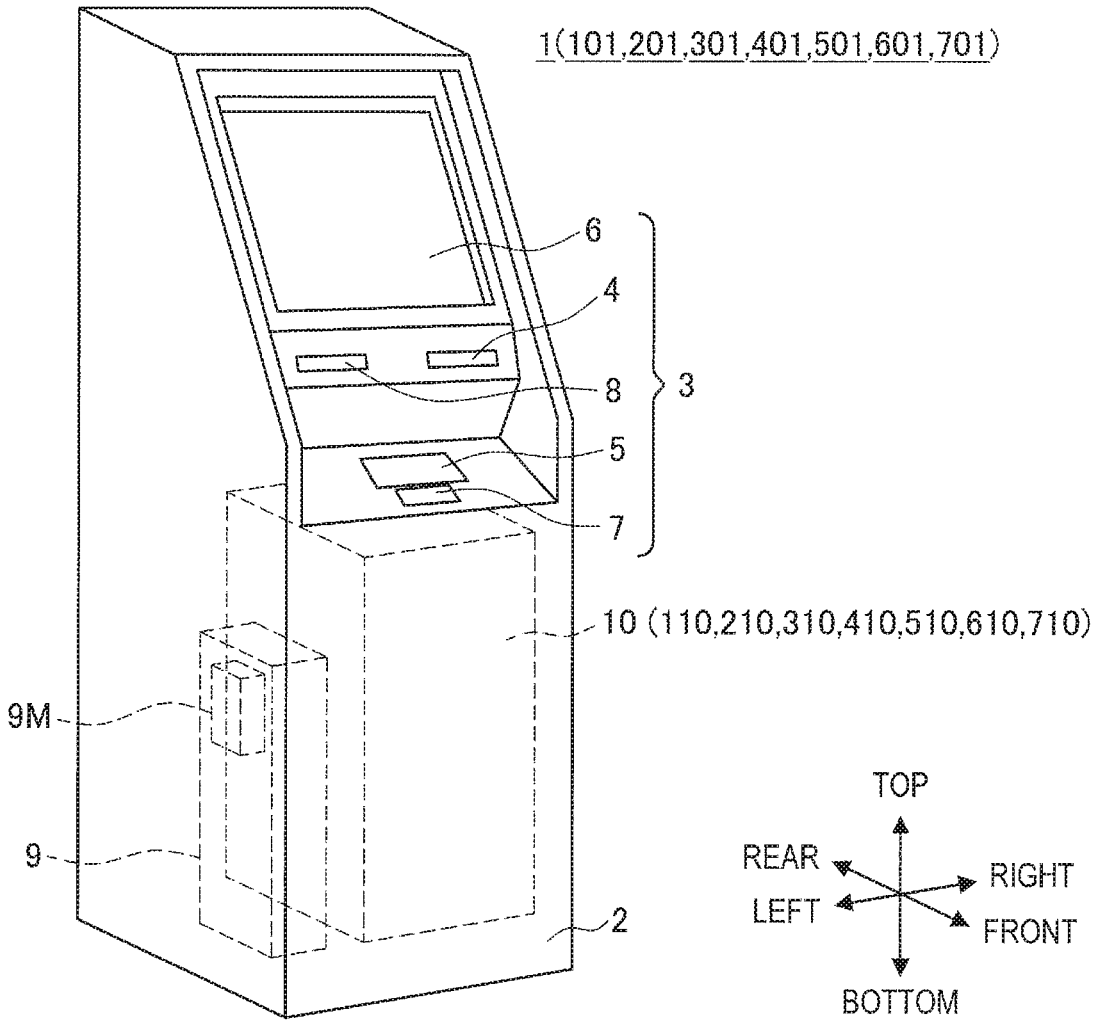
FIG. 1 is a schematic perspective view illustrating a configuration of an ATM.

As shown in the exterior of FIG. 1, an ATM 1 is mainly constituted of a box-like housing 2 and installed in, for example, a financial institution, etc. and performs cash-related transactions for deposit transactions, withdrawal transactions, etc. with users. Hereinafter, a side facing a user in the ATM 1 is designated as a front side, the opposite side is designated as a rear side, the left and right when viewed by the user facing the front side are designated as a left side and a right side, and an upper side and a lower side are further defined as will be described.

In the housing 2, a customer interaction unit 3 is provided at a position at which insertion of a banknote, operation by a touch panel, etc. are facilitated in a state in which the user faces the front side of the housing 2. The customer interaction unit 3 directly exchanges cash, a passbook, etc. with the user who is, for example, a customer of the financial institution, and is configured to perform notification of information related to a transaction and reception of an operation instruction, and a card input/output port 4, a deposit/withdrawal port 5, an operation display unit 6, a numeric keypad 7, and a receipt issuance port 8 are provided.

The card input/output port 4 is a part into or from which various types of cards such as cash cards are inserted or discharged. A card processing unit 4A (FIG. 3) for reading an account number, etc. magnetically recorded on the various types of cards is provided on a back side of the card input/output port 4. The deposit/withdrawal port 5 is a part into which the user inserts a banknote to be deposited and from which a banknote to be withdrawn by the user is discharged.

The operation display unit 6 includes a touch panel in which a liquid crystal display (LCD) for displaying an operation screen during a transaction and a touch sensor for inputting selection of a transaction type, an authentication number, an amount of money of the transaction, etc. are integrated. The numeric keypad 7 includes physical keys for receiving inputs of numbers of "0" to "9", etc. and is used during an operation of inputting the authentication number, the amount of money of the transaction, etc. The receipt issuance port 8 is a part for issuing a receipt on which transaction content is printed when the transaction process ends. On the back side of the receipt issuance port 8, a receipt processing unit 8A (FIG. 3) for printing the transaction content on the receipt is provided.

Within the housing 2, a main control unit 9 for generally controlling the entire ATM 1, a banknote deposit/withdrawal mechanism 10 for performing various processes related to the banknotes, and the like are provided.

The main control unit 9 is mainly constituted of a central processing unit (CPU) (not illustrated) and performs various processes such as a deposit transaction and a withdrawal transaction by reading a predetermined program from a read only memory (ROM) (not illustrated), a flash memory (not illustrated), or the like to execute the read program. Also, the main control unit 9 internally has a storage unit 9M constituted of a random access memory (RAM), a hard disk drive, or a flash memory, and causes the storage unit 9M to store various information.

Figure 2:
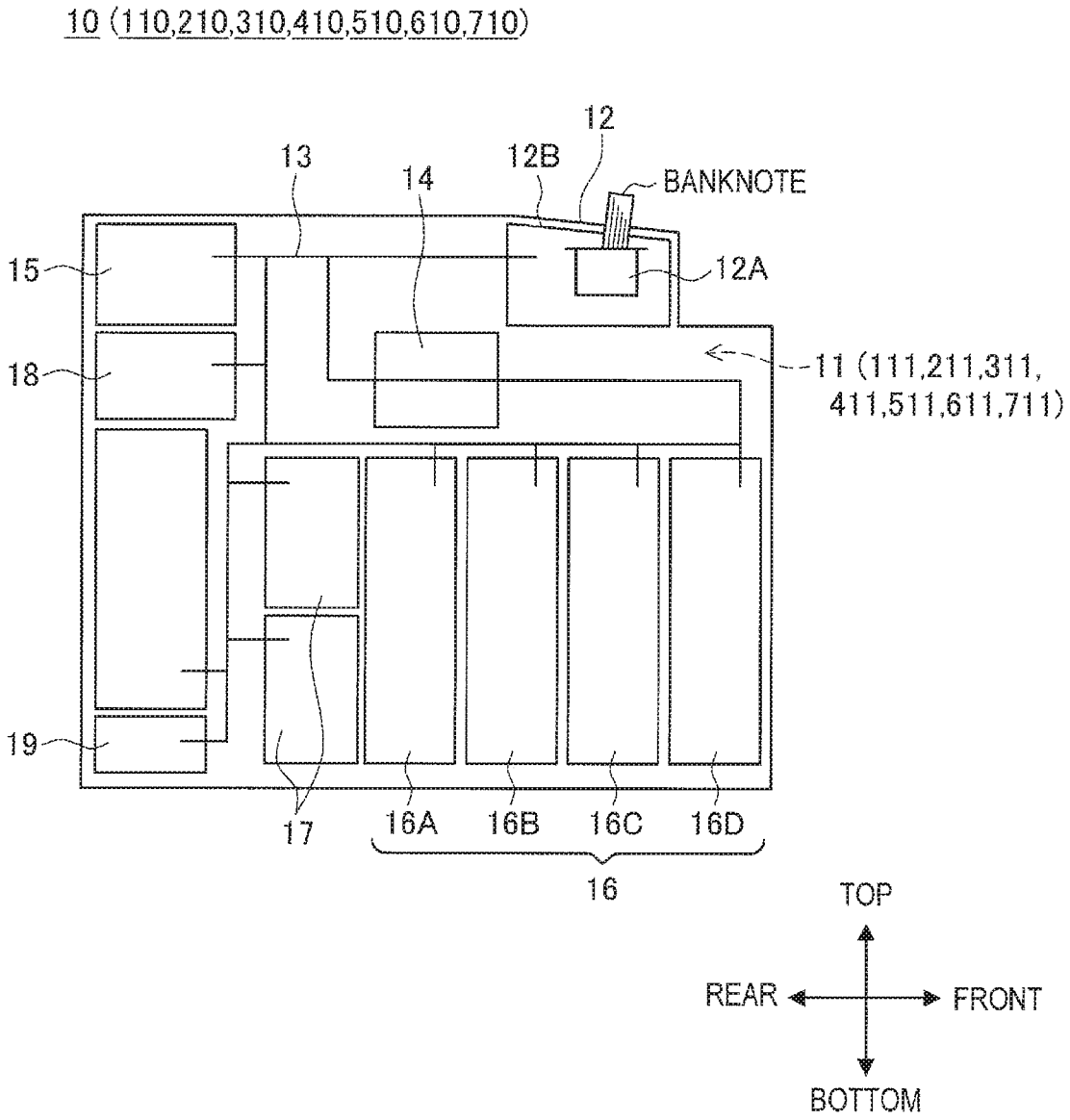
FIG. 2 is a schematic diagram illustrating a configuration of a banknote deposit/withdrawal mechanism.

As illustrated in a side view of FIG. 2, a banknote control unit 11, a deposit/withdrawal unit 12, a transport unit 13, a discrimination unit 14, a temporary holding unit 15, a banknote storage compartment 16, a reject compartment 17, an untaken banknote storage compartment 18, and a counterfeit note storage compartment 19 are provided in the banknote deposit/withdrawal mechanism 10.

Also, a serial number is assigned to the banknote to be handled by the banknote deposit/withdrawal mechanism 10. The serial number is an identification number uniquely assigned to each banknote and is constituted of a combination of a plurality of characters or symbols. The serial number is used to specify an individual banknote, etc.

Figure 3:
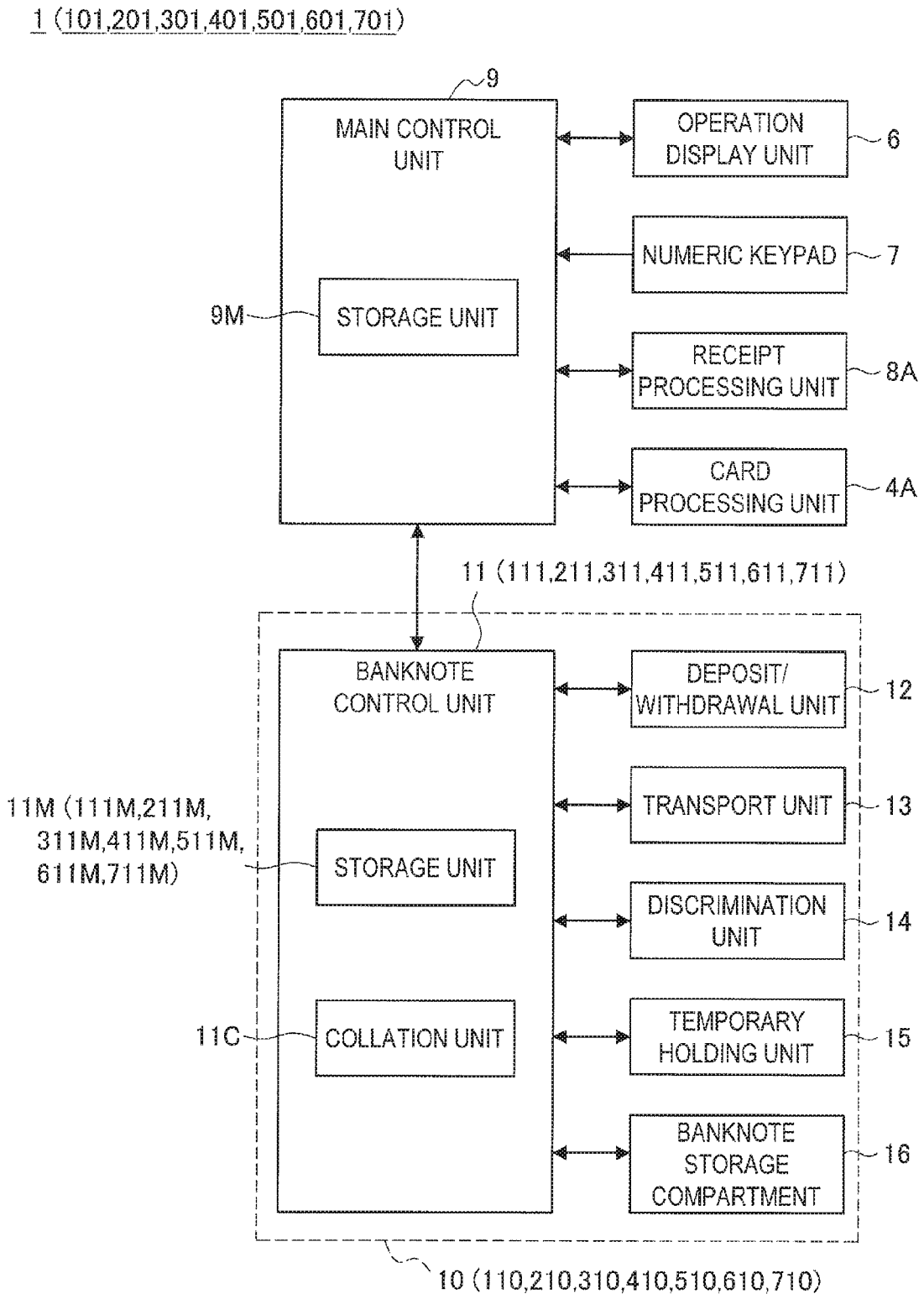
FIG. 3 is a schematic diagram illustrating a block configuration of the ATM and the banknote deposit/withdrawal mechanism.

As illustrated in a block configuration of the banknote deposit/withdrawal mechanism 10 including the entire ATM 1 in FIG. 3, the banknote control unit 11 generally controls the banknote deposit/withdrawal mechanism 10 in conjunction with the main control unit 9. Similar to the main control unit 9, the banknote control unit 11 is mainly constituted of a CPU (not illustrated) and performs various processes such as a deposit process and a withdrawal process by executing a predetermined program.

Also, the banknote control unit 11 internally has a storage unit 11M including a RAM, a flash memory, etc. and causes the storage unit 11M to store various types of programs such as a withdrawal program or various information such as banknote-related information. Also, the storage unit 11M pre-stores a counterfeit note serial number list (not illustrated) in which serial numbers of known counterfeit notes are written. Further, a collation unit 11C is provided inside the banknote control unit 11. This collation unit 11C determines whether two serial numbers are the same by collating the two serial numbers.

The deposit/withdrawal unit 12 (FIG. 2) is mainly constituted of a box-like container 12A of which an upper portion is opened. The container 12A contains banknotes to be transferred to the user or banknotes to be transferred from the user aligned in a forward or backward direction. A shutter 12B capable of being opened and closed is provided above the container 12A.

The transport unit 13 forms a transport path in which portions within the banknote deposit/withdrawal mechanism 10 are connected by a motor, a roller, a belt, a guide, etc. which are not illustrated. The transport unit 13 transports banknotes along the transport path in which a direction along a short side of the banknotes is designated as a traveling direction by appropriately rotating the roller and appropriately running the belt.

The discrimination unit 14 internally has various sensors such as an optical sensor, an image sensor, and a magnetic sensor, obtains a discrimination result by each sensor while the banknotes are internally transported, and supplies the discrimination result to the banknote control unit 11. Accordingly, the banknote control unit 11 determines the denomination and genuineness of the banknote, a degree of damage of the banknote, etc. on the basis of the acquired discrimination result and according to a process of comparing a read serial number with a counterfeit note serial number list or the like and then determines a transport destination of each banknote.

The temporary holding unit 15 adopts a so-called tape escrow scheme, stores the banknotes by winding the banknotes on a peripheral side surface of a cylindrical drum together with a tape and dispatches the banknotes by pulling off the tape from the peripheral side surface. The temporary holding unit 15 can maximally store, for example, 200 banknotes.

The banknote storage compartment 16 (16A, 16B, 16C, and 16D) internally accumulates and stores a large number of banknotes. For example, in the deposit transaction, this banknote storage compartment 16 receives and stores banknotes when banknotes for which a degree of damage is small and discriminated to be reusable in the discrimination unit 14 are sorted according to each denomination and transported by the transport unit 13. Also, the banknote storage compartment 16 separately dispatches an indicated number of banknotes one by one to sequentially transfer the banknotes to the transport unit 13 on the basis of control of the banknote control unit 11 in the withdrawal transaction.

Further, each banknote storage compartment 16 is configured to be removable from the housing of the banknote deposit/withdrawal mechanism 10. For example, the banknote storage compartment 16 is extracted from the banknote deposit/withdrawal mechanism 10 when all stored banknotes are dispatched or when the business hours of one day end, and is re-mounted on the banknote deposit/withdrawal mechanism 10 after new banknotes are stored.

The reject compartment 17 stores a banknote (so-called rejected banknote) discriminated not to be reusable because the degree of damage is large in the discrimination unit 14. The untaken banknote storage compartment 18 stores banknotes untaken from the deposit/withdrawal unit 12 by the user. The counterfeit note storage compartment 19 stores banknotes (that is, counterfeit notes) determined to be counterfeit notes on the basis of a discrimination result of the discrimination unit 14.

1-2. Deposit Process

Next, a banknote deposit process in the banknote deposit/withdrawal mechanism 10 will be described. For example, in a state in which a transaction process with the user can be performed, that is, a so-called operation state, the ATM 1 awaits an operation instruction for starting each type of transaction process from the user in a state in which a predetermined menu screen (not illustrated) is displayed on the operation display unit 6 (FIG. 1).

When the operation instruction for starting the deposit transaction is received from the user, the main control unit 9 of the ATM 1 instructs the banknote control unit 11 of the banknote deposit/withdrawal mechanism 10 to start the deposit process. Accordingly, the banknote control unit 11 starts the deposit process by reading a predetermined deposit program from the storage unit 11M to execute the read predetermined deposit program.

First, the banknote control unit 11 opens the shutter 12B of the deposit/withdrawal unit 12 and causes the banknotes to be inserted into the container 12A. When the operation instruction for starting reception is received via the operation display unit 6 after the user inserts the banknotes into the container 12A, the deposit/withdrawal unit 12 closes the shutter 12B and receives the banknotes from the container 12A one by one to transfer the banknotes to the transport unit 13. The transport unit 13 causes the banknotes to travel in a short side direction and transports the banknotes to the discrimination unit 14.

The discrimination unit 14 notifies the banknote control unit 11 of a detection result by each sensor while the banknotes are internally transported. The banknote control unit 11 determines the denomination and genuineness of the banknotes, a degree of damage of the banknotes, and the like on the basis of the discrimination result acquired from the discrimination unit 14 or read serial numbers or the like and then determines a transport destination of the banknotes on the basis of a determination result of each banknote.

Specifically, while the banknote control unit 11 causes the banknote which is discriminated to be proper and to be transacted to be transported to and stored in the temporary holding unit 15 by the transport unit 13, the rejected banknote discriminated not to be transacted is transported to the deposit/withdrawal unit 12 by the transport unit 13 and returned to the user.

Then, when all banknotes inserted into the deposit/withdrawal unit 12 are completely received, the banknote control unit 11 calculates a deposit amount on the basis of the discrimination result obtained from the discrimination unit 14, presents the calculated deposit amount to the user by displaying the calculated deposit amount on the operation display unit 6 (FIG. 1), and asks about whether to continue a deposit transaction. Here, when an indication indicating that the deposit transaction continues is received from the user, the banknote control unit 11 transports the banknote held in the temporary holding unit 15 to the discrimination unit 14 by the transport unit 13, causes the discrimination unit 14 to discriminate the denomination of the banknote, the degree of damage of the banknote, and the like, and acquires discrimination results.

Next, the banknote control unit 11 designates the banknote for which a degree of damage of the banknote is small as the banknote to be reusable and causes the banknote to be transported to and stored in the banknote storage compartment 16 by controlling the transport unit 13 after the banknotes are sorted for each denomination by the transport unit 13. On the other hand, the banknote control unit 11 designates the banknote for which the degree of damage is large as a rejected banknote which is not reusable and causes the banknote to be transported to and stored in the reject compartment 17. Also, the banknote control unit 11 causes the banknote (that is, a counterfeit note) determined to be counterfeited to be transported to and stored in the counterfeit note storage compartment 19.

On the other hand, when an indication indicating that the deposit transaction does not continue is received from the user, the banknote control unit 11 sequentially dispatches all banknotes held in the temporary holding unit 15, sequentially transports the banknotes to the deposit/withdrawal unit 12 by the transport unit 13, and returns the banknotes to the user. When all the banknotes are contained within the container 12A, the banknote control unit 11 opens the shutter 12B and allows the user to extract the banknotes.

At this time, when banknotes remain within the container 12A even after a predetermined waiting time (for example, 30 sec) has elapsed from the opening of the shutter 12B, the banknote control unit 11 determines that the user has forgotten to take the banknotes and left, that is, that forgetting to take the banknotes has occurred. Next, the banknote control unit 11 receives the banknotes within the container 12A one by one, causes the discrimination unit 14 to discriminate each banknote by transporting the banknotes to the discrimination unit 14 by the transport unit 13, causes all the banknotes to be transported to and stored in the untaken banknote storage compartment 18 after the banknotes are transported to the temporary holding unit 15, and awaits the start of the next transaction.

Thus, while the banknote deposit/withdrawal mechanism 10 discriminates the banknotes deposited by the user in the deposit transaction one by one by the discrimination unit 14, sorts the banknotes which are proper and reusable for each denomination, and causes the banknote storage compartment 16 to store the banknotes, the rejected banknote and the counterfeit note that are not reusable are stored by the reject compartment 17 and the counterfeit note storage compartment 19, respectively.

1-3. Withdrawal Process

Figure 4:
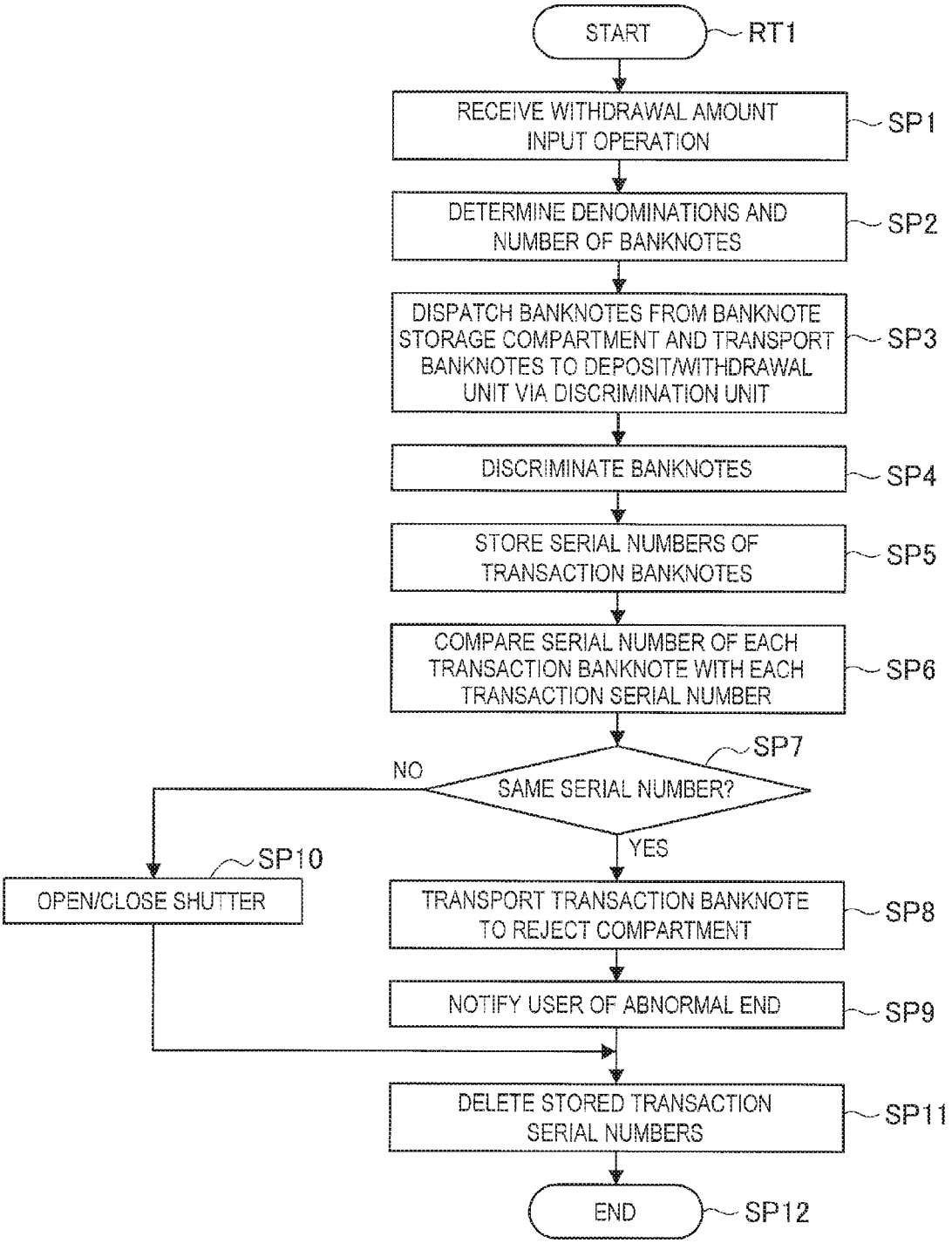
FIG. 4 is a flowchart illustrating a withdrawal processing procedure according to a first embodiment.

Next, a banknote withdrawal process in the banknote deposit/withdrawal mechanism 10 will be described. The main control unit 9 of the ATM 1 instructs the banknote control unit 11 of the banknote deposit/withdrawal mechanism 10 to start the withdrawal process when an operation instruction for starting the withdrawal process is received from the user in a state in which the above-described menu screen is displayed on the operation display unit 6 (FIG. 1). Accordingly, the banknote control unit 11 starts a withdrawal processing procedure RT1 illustrated in FIG. 4 by reading a withdrawal program from the storage unit 11M to execute the read withdrawal program and moves to step SP1.

The banknote control unit 11 receives an operation of inputting a withdrawal amount from the user via the operation display unit 6 in conjunction with the main control unit 9 (FIG. 3) in step SP1, moves to the next step SP2 to determine banknotes based on the denominations and the number of banknotes according to the input withdrawal amount, and moves to the next step SP3.

The banknote control unit 11 sequentially dispatches the determined banknotes based on the denominations and the number of banknotes from the banknote storage compartment 16 and causes the banknotes to be transported to the deposit/withdrawal unit 12 via the discrimination unit 14 by the transport unit 13 in step SP3, and moves to the next step SP4. The banknote control unit 11 moves to the next step SP5 after causing banknotes currently being transported to be sequentially discriminated by the discrimination unit 14, acquiring discrimination results, and reading serial numbers of the discriminated banknotes in step SP4.

At this time, the banknote control unit 11 designates banknotes which are not determined to be normal like a plurality of banknotes transported in an overlapping state (that is, doubly fed) as rejected banknotes and causes the rejected banknotes to be transported to the reject compartment 17. Also, the banknote control unit 11 causes the banknotes determined to be counterfeit notes, that is, the banknotes having serial numbers matching the counterfeit note serial number list pre-stored by the banknote control unit 11, to be transported to the counterfeit note storage compartment 19.

On the other hand, the banknote control unit 11 causes normal banknotes to be transported to the deposit/withdrawal unit 12 in an amount of money corresponding to a withdrawal amount and the normal banknotes are contained within the container 12A. Hereinafter, banknotes to be withdrawn by the user in the withdrawal transaction as banknotes transported to the deposit/withdrawal unit 12 as described above, that is, banknotes based on the denominations and the number of banknotes determined according to a deposit amount, are referred to as transaction banknotes.

In step SP5, the banknote control unit 11 stores serial numbers of all transaction banknotes in the transaction serial number list L1 as illustrated in FIG. 5, and causes the storage unit 11M to store the transaction serial number list L1. The process moves to the next step SP6. Hereinafter, the serial number of the transaction banknote stored as described above is referred to as a transaction serial number. In the transaction serial number list L1, information indicating the serial number and the denomination of each banknote is stored in association with order information necessary for management.

Because the counterfeit note is stored in the counterfeit note storage compartment 19 in step SP3 even when the banknote having the serial number matching the counterfeit note serial number list, that is, the counterfeit note, is included among the banknotes dispatched from the banknote storage compartment 16, the counterfeit note is already excluded from the transaction banknotes within the deposit/withdrawal unit 12. Thus, no serial number of a counterfeit note as described above is stored in the transaction serial number list L1.

The banknote control unit 11 collates each transaction serial number with all other transaction serial numbers stored in the transaction serial number list L1 by the collation unit 11C in step SP6 and moves to the next step SP7. Thereby, the banknote control unit 11 compares the serial number of each transaction banknote stored in the deposit/withdrawal unit 12 with serial numbers of all the other transaction banknotes. At this time, the banknote control unit 11 compares the serial numbers of the same denomination after sorting the transaction banknotes for each denomination.

In step SP7, the banknote control unit 11 determines whether the same serial number as another transaction serial number is among the transaction serial numbers, that is, whether banknotes having the same serial number as each other are included among the transaction banknotes.

When the positive result is obtained here, this indicates that there are originally no banknotes having the same serial number because the serial number is uniquely assigned, but a banknote having the same serial number is among actual transaction banknotes. This indicates that an abnormality handling process should be performed without transferring the transaction banknotes to the user because the transaction banknote having the same serial number is likely to be a newly counterfeited banknote (counterfeit note). At this time, the banknote control unit 11 moves to the next step SP8.

The banknote control unit 11 transports the transaction banknotes contained within the deposit/withdrawal unit 12, that is, all transaction banknotes including both the counterfeit note and the normal banknote, to the reject compartment 17 by controlling the transport unit 13 in step SP8, and moves to the next step S9.

The banknote control unit 11 notifies the user of the fact that the current withdrawal transaction is stopped because an abnormality has occurred in an internal process and the fact that a fresh start is requested from the beginning of the withdrawal process by displaying a predetermined notification screen on the operation display unit 6 (FIG. 1) in step SP9, and moves to the next step SP11.

On the other hand, when the negative result is obtained in step SP7, this indicates that serial numbers of all the transaction banknotes are different from each other and no counterfeit note is included among the transaction banknotes. At this time, the banknote control unit 11 moves to the next step SP10.

The banknote control unit 11 moves to the next step SP11 after opening the shutter 12B of the deposit/withdrawal unit 12, allowing the user to extract the transaction banknote within the container 12A, and closing the shutter 12B in step SP10.

The banknote control unit 11 determines that forgetting to take a banknote has occurred as in the case of the deposit process when the banknote remains within the container 12A even after a predetermined waiting time (for example, 30 sec) has elapsed from the opening of the shutter 12B in step SP10. At this time, the banknote control unit 11 receives the banknote within the container 12A and transports the banknote to the untaken banknote storage compartment 18 after each banknote is discriminated by the discrimination unit 14.

The banknote control unit 11 prepares for the next withdrawal transaction by deleting all transaction serial numbers stored in the storage unit 11M in a state in which the transaction serial numbers are stored in the transaction serial number list L1 (FIG. 5) in step SP11 and moves to the next step SP12 to end the withdrawal processing procedure RT1.

1-4. Operation and Effects

In the above configuration, the banknote deposit/withdrawal mechanism 10 of the ATM 1 according to the first embodiment reads serial numbers of all transaction banknotes by the discrimination unit 14, stores the read serial numbers as transaction serial numbers in the transaction serial number list L1, and causes the transaction serial number list L1 to be stored in the storage unit 11M. Further, the banknote deposit/withdrawal mechanism 10 confirms whether a banknote having the same serial number is among the transaction banknotes by comparing each transaction serial number with another transaction serial number by the banknote control unit 11.

Thereby, when a plurality of banknotes having the same serial number are included among the transaction banknotes, the banknote deposit/withdrawal mechanism 10 can detect that the plurality of banknotes having the same serial number are included. That is, for example, when banknotes newly counterfeited and having the same serial number are included among the transaction banknotes, the banknote deposit/withdrawal mechanism 10 cannot determine the banknotes as counterfeit notes in a process of collating their serial numbers with the counterfeit note serial number list, but can determine the banknotes as the counterfeit notes according to the collation process using the transaction serial numbers. As a result, the banknote deposit/withdrawal mechanism 10 can increase the precision of detection of counterfeit notes more than in the past.

Also, when a plurality of banknotes having the same serial number are included among the transaction banknotes, the banknote deposit/withdrawal mechanism 10 transports all the transaction banknotes to the reject compartment 17 to cause the transaction banknotes to be stored in the reject compartment 17 as an abnormality handling process and continues the operation. Thus, because the banknote deposit/withdrawal mechanism 10 can start a new transaction process without causing an employee or a maintenance worker of a financial institution or the like to perform particular maintenance work thereafter, it is unnecessary to decrease an operation rate of the ATM 1.

At this time, because the banknote deposit/withdrawal mechanism 10 transports all the transaction banknotes to the reject compartment 17 and stores all the transaction banknotes in the reject compartment 17 without dispending any of the transaction banknotes, for example, it is possible to cause an employee or a maintenance worker of a financial institution, or the like to confirm a detailed situation while referring to all the transaction banknotes ex post facto.

Also, because the banknote deposit/withdrawal mechanism 10 mutually collates serial numbers of all transaction banknotes in one transaction process, it is possible to relatively reduce the number of serial numbers serving as collation targets and complete this collation process in a relatively short time. Thus, the banknote deposit/withdrawal mechanism 10 increases the precision of detection of counterfeit notes more than in the past without increasing a waiting time of the user in the withdrawal transaction.

Further, when the serial number of the banknote dispatched from the banknote storage compartment 16 is the same as the counterfeit note serial number, the banknote deposit/withdrawal mechanism 10 does not designate the banknote as the transaction banknote because the banknote is previously determined to be a counterfeit note and stored in the counterfeit note storage compartment 19 without being transported to the deposit/withdrawal unit 12. Thus, the banknote deposit/withdrawal mechanism 10 does not redundantly store the serial number of the banknote stored in the counterfeit note serial number list and previously determined to be the counterfeit note in the transaction serial number list L1 and does not perform a redundant collation process by the banknote control unit 11.

Also, when the banknote having the same serial number is included in the withdrawal process and no banknote is withdrawn, there is no risk of confusing the user in the operation procedure or the like because it is only necessary for the banknote deposit/withdrawal mechanism 10 to reperform the same withdrawal procedure without causing the user to perform an operation or work different from an operation in the immediately previous withdrawal transaction.

According to the above configuration, the banknote deposit/withdrawal mechanism 10 of the ATM 1 according to the first embodiment confirms whether a banknote having the same serial number is among the transaction banknotes by comparing each transaction serial number obtained by reading the serial number of each transaction banknote with another transaction serial number. Thereby, when a plurality of counterfeit notes having the same serial number are among the transaction banknotes, the banknote deposit/withdrawal mechanism 10 cannot determine the transaction banknotes as the counterfeit notes in the process of collating the serial numbers with the counterfeit note serial number list, but can determine that transaction banknotes are the counterfeit notes in the collation process between the transaction serial numbers. In this case, the banknote deposit/withdrawal mechanism 10 can previously prevent the counterfeit note from being transferred to the user by transporting a relevant transaction banknote to the reject compartment 17 together with all other transaction banknotes.

2. Second Embodiment

An ATM 101 (FIG. 1) according to the second embodiment is different from the ATM 1 according to the first embodiment in that a banknote deposit/withdrawal mechanism 110 is provided in place of the banknote deposit/withdrawal mechanism 10, and other elements are configured to be similar to those of the first embodiment. The banknote deposit/withdrawal mechanism 110 (FIGS. 2 and 3) is different from the banknote deposit/withdrawal mechanism 10 according to the first embodiment in that a banknote control unit 111 is provided in place of the banknote control unit 11, but other elements are configured to be similar to those of the first embodiment.

Similar to the banknote control unit 11 according to the first embodiment, the banknote control unit 111 is mainly constituted of a CPU (not illustrated) and performs various processes such as a deposit process and a withdrawal process by reading and executing a predetermined program. Also, the banknote control unit 111 has a storage unit 111M in place of the storage unit 11M. Similar to the storage unit 11M, the storage unit 111M stores various types of programs or various information such as discrimination information, but stores a withdrawal program partially different from that of the first embodiment.

The banknote deposit/withdrawal mechanism 110 executes a similar deposit process according to a deposit program similar to that of the first embodiment in the deposit transaction.

2-1. Withdrawal Process

Next, a banknote withdrawal process in the banknote deposit/withdrawal mechanism 110 will be described. When the withdrawal transaction with the user is performed in the banknote deposit/withdrawal mechanism 10, the banknote control unit 111 of the banknote deposit/withdrawal mechanism 110 starts a withdrawal processing procedure RT2 illustrated in FIG. 6 corresponding to FIG. 4 by reading the withdrawal program from the storage unit 111M to execute the withdrawal program and moves to step SP21.

The banknote control unit 111 performs processes similar to those of steps SP1 to SP7 (FIG. 4) in steps SP21 to SP27. When the positive result is obtained in step SP27, the banknote control unit 111 moves to the next step SP28.

The banknote control unit 111 transports all transaction banknotes contained within the deposit/withdrawal unit 12 to the temporary holding unit 15 in step SP28 and moves to the next step SP29. The banknote control unit 111 transports the transaction banknotes stored in the temporary holding unit 15 to the discrimination unit 14 one by one to cause the discrimination unit 14 to discriminate the transaction banknotes in step SP29 and moves to the next step SP30 after acquiring a discrimination result and reading serial numbers.

In step SP30, the banknote control unit 111 determines whether the transaction banknote discriminated in the discrimination unit 14 is a transaction banknote having the same serial number as another transaction banknote, that is, determines whether the transaction banknote is not registered in the counterfeit note serial number list, but is determined as a counterfeit note. When the positive result is obtained here, the banknote control unit 111 moves to the next step SP31 to cause the transport unit 13 to transport the transaction banknote to the counterfeit note storage compartment 19 and then moves to the next step SP33.

On the other hand, when the negative result is obtained in step SP30, this indicates that the transaction banknote is a normal banknote and is appropriate for the user to withdraw in the next and subsequent withdrawal transactions. At this time, the banknote control unit 111 moves to the next step SP32 to cause the transaction banknote to be transported to the proper banknote storage compartment 16 by the transport unit 13 according to its denomination and moves to the next step SP33.

In step SP33, the banknote control unit 111 determines whether all transaction banknotes are transported from the temporary holding unit 15 to the counterfeit note storage compartment 19 or the banknote storage compartment 16. When the negative result is obtained here, the banknote control unit 111 iterates a series of processes by returning to step SP29 again to transport the remaining transaction banknotes.

On the other hand, when the positive result is obtained in step SP33, the banknote control unit 111 moves to the next step SP34 and notifies the user of the fact that the current withdrawal transaction is stopped because an abnormality has occurred in an internal process and the fact that a fresh start is requested from the beginning of the withdrawal process by displaying a predetermined notification screen on the operation display unit 6 (FIG. 1) as in step SP9 (FIG. 4), and moves to the next step SP36.

On the other hand, when the negative result is obtained in step SP27, this indicates that serial numbers of all the transaction banknotes are different from each other and no counterfeit note is included among the transaction banknotes. At this time, the banknote control unit 111 moves to the next step SP35 to open/close the shutter 12B of the deposit/withdrawal unit 12 and allow the user to extract the transaction banknote within the container 12A as in step SP10 (FIG. 4) and then moves to the next step SP36.

The banknote control unit 111 prepares for the next withdrawal transaction by deleting all transaction serial numbers stored in the storage unit 111M as in step SP11 (FIG. 4) in step SP36 and moves to the next step SP37 to end the withdrawal processing procedure RT2.

2-2. Operation and Effects

In the above configuration, the banknote deposit/withdrawal mechanism 110 of the ATM 101 according to the second embodiment reads serial numbers of all transaction banknotes by the discrimination unit 14, stores the read serial numbers as transaction serial numbers in the transaction serial number list L1, and causes the transaction serial number list L1 to be stored in the storage unit 111M. Further, the banknote deposit/withdrawal mechanism 110 confirms whether a banknote having the same serial number is among the transaction banknotes by comparing each transaction serial number with another transaction serial number by the banknote control unit 111.

Thereby, as in the first embodiment, when a plurality of transaction banknotes having the same serial number are included among transaction banknotes, the banknote deposit/withdrawal mechanism 110 can detect the plurality of transaction banknotes having the same serial number and determine that the transaction banknotes are counterfeit notes.

Also, when a plurality of banknotes having the same serial number are included among the transaction banknotes, the banknote deposit/withdrawal mechanism 10 causes only the transaction banknotes which are counterfeit notes having the same serial number to be transported to and stored in the counterfeit note storage compartment 19 as the abnormality handling process. On the other hand, the banknote deposit/withdrawal mechanism 10 returns other normal transaction banknotes to the banknote storage compartment 16. Thus, the banknote deposit/withdrawal mechanism 10 can cause the banknotes determined as normal banknotes to be withdrawn in the next and subsequent withdrawal transactions and utilize the banknotes as effectively as possible.

In other regards, the banknote deposit/withdrawal mechanism 110 according to the second embodiment can have operation and effects similar to those of the banknote deposit/withdrawal mechanism 10 according to the first embodiment.

According to the above configuration, the banknote deposit/withdrawal mechanism 110 of the ATM 101 according to the second embodiment confirms whether a banknote having the same serial number is among the transaction banknotes by comparing each transaction serial number obtained by reading the serial number of each transaction banknote with another transaction serial number. Thereby, when a plurality of counterfeit notes newly counterfeited and having the same serial number are included among the transaction banknotes, the banknote deposit/withdrawal mechanism 110 can determine that transaction banknotes are the counterfeit notes in the collation process between the transaction serial numbers, previously prevent the counterfeit note from being transferred to the user by storing the counterfeit note in the counterfeit note storage compartment 19, and effectively reuse other normal banknotes by returning the other normal banknotes to the banknote storage compartment 16.

3. Third Embodiment

An ATM 201 (FIG. 1) according to the third embodiment is different from the ATM 1 according to the first embodiment in that a banknote deposit/withdrawal mechanism 210 is provided in place of the banknote deposit/withdrawal mechanism 10, and other elements are configured to be similar to those of the first embodiment. The banknote deposit/withdrawal mechanism 210 (FIGS. 2 and 3) is different from the banknote deposit/withdrawal mechanism 10 according to the first embodiment in that a banknote control unit 211 is provided in place of the banknote control unit 11, but other elements are configured to be similar to those of the first embodiment.

Similar to the banknote control unit 11 according to the first embodiment, the banknote control unit 211 is mainly constituted of a CPU (not illustrated) and performs various processes such as a deposit process and a withdrawal process by reading and executing a predetermined program. Also, the banknote control unit 211 has a storage unit 211M in place of the storage unit 11M. Similar to the storage unit 11M, the storage unit 211M stores various types of programs or various information such as discrimination information, but stores a withdrawal program partially different from those of the first and second embodiments.

The banknote deposit/withdrawal mechanism 210 executes a similar deposit process according to a deposit program similar to that of the first embodiment in the deposit transaction.

3-1. Withdrawal Process

Next, a banknote withdrawal process in the banknote deposit/withdrawal mechanism 210 will be described. When the withdrawal transaction with the user is performed in the ATM 201, the banknote control unit 211 of the banknote deposit/withdrawal mechanism 210 starts a withdrawal processing procedure RT3 illustrated in FIG. 7 corresponding to FIGS. 4 and 6 by reading the withdrawal program from the storage unit 211M to execute the withdrawal program and moves to step SP41.

The banknote control unit 211 performs processes similar to those of steps SP21 to SP31 (FIG. 6) in steps SP41 to SP51 and moves to the next step SP53. When the negative result is obtained in step SP50, this indicates that the transaction banknote is normal and can be withdrawn by the user. At this time, the banknote control unit 211 moves to the next step SP52 to transport the transaction banknote to the deposit/withdrawal unit 12 by the transport unit 13 and moves to the next step SP53.

Figure 6:
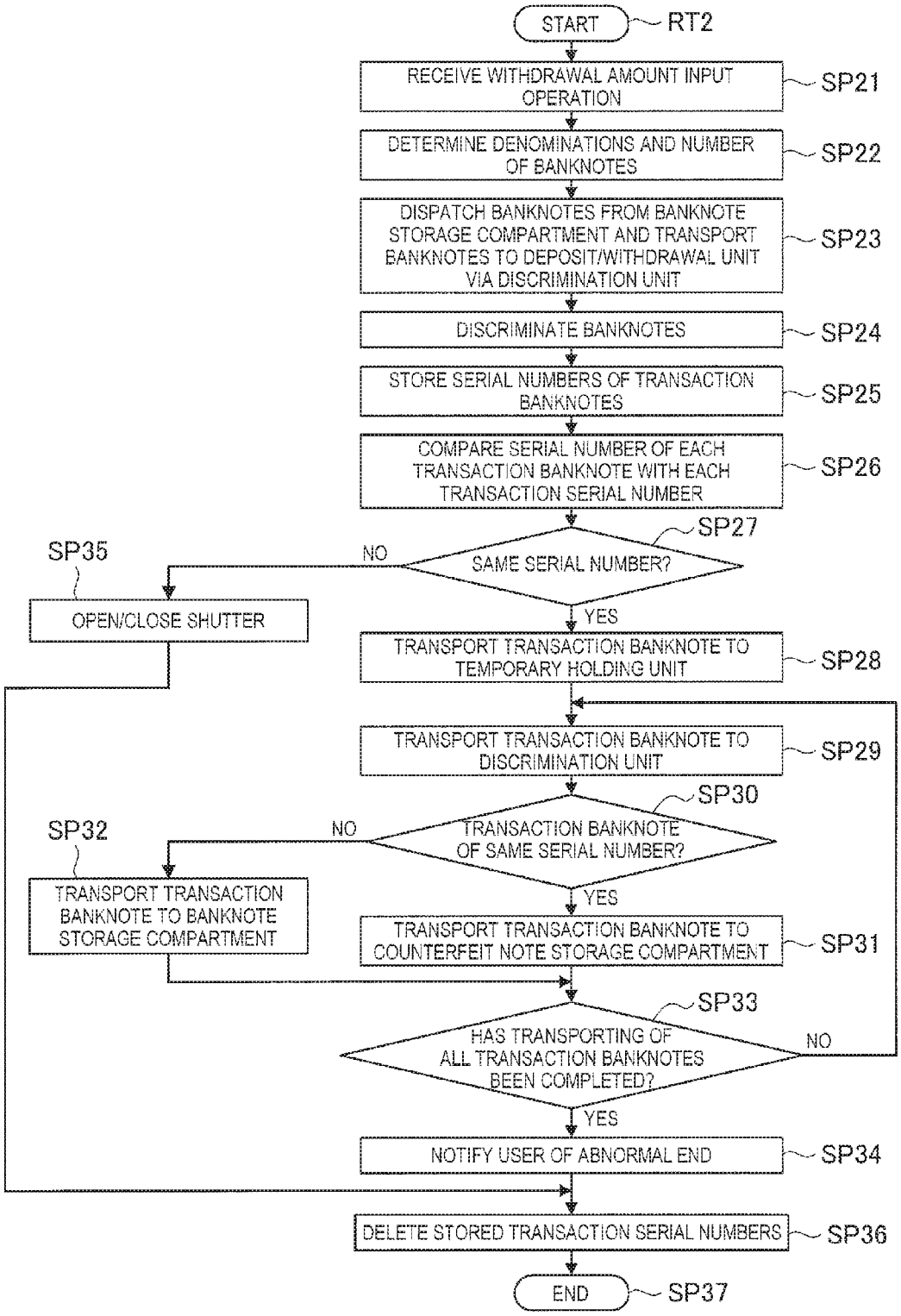
FIG. 6 is a flowchart illustrating a withdrawal processing procedure according to a second embodiment.
Figure 7:
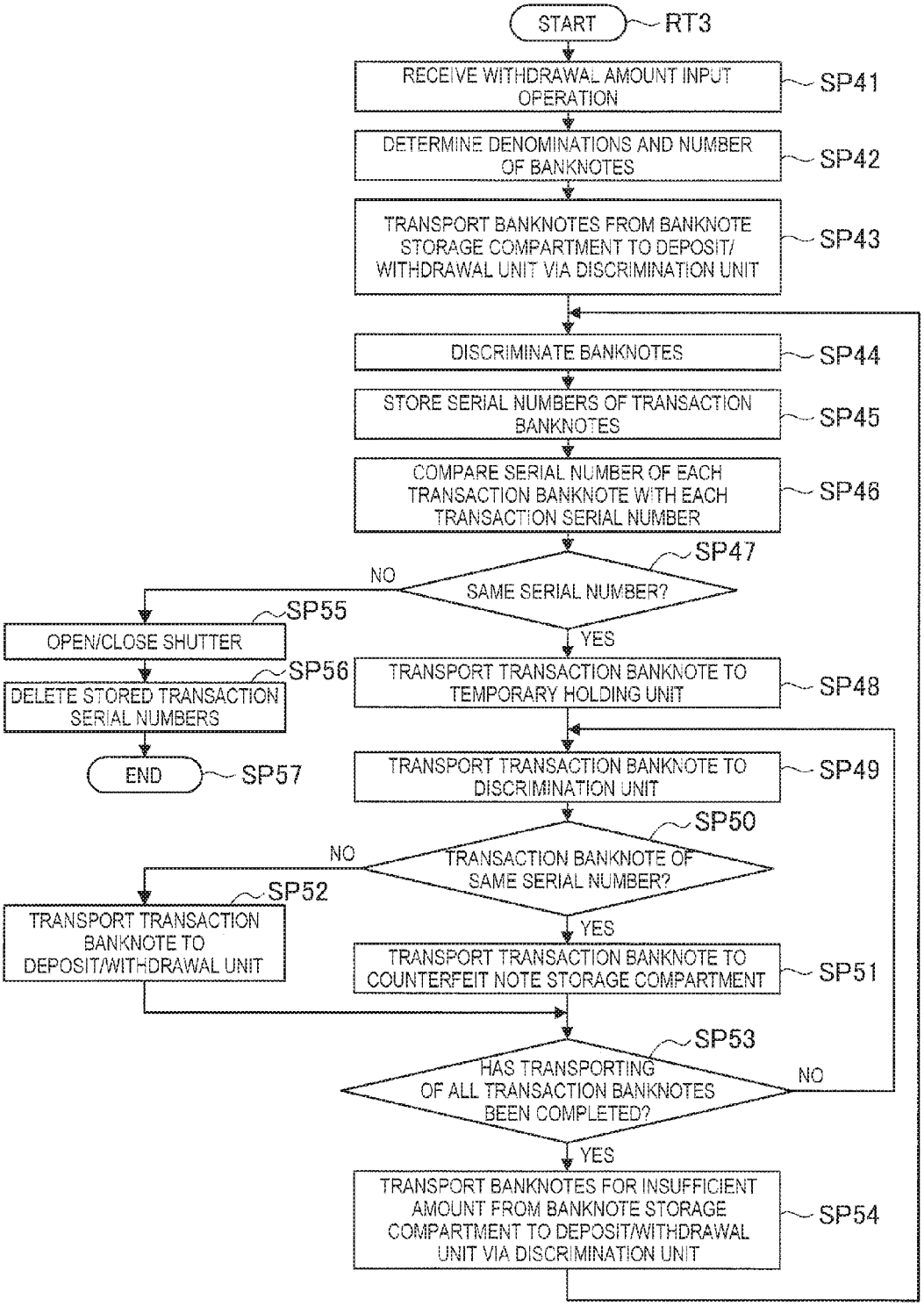
FIG. 7 is a flowchart illustrating a withdrawal processing procedure according to a third embodiment.

In step SP53, the banknote control unit 211 determines whether all transaction banknotes are transported from the temporary holding unit 15 to the counterfeit note storage compartment 19 or the deposit/withdrawal unit 12 as in step SP33 (FIG. 6). When the negative result is obtained here, the banknote control unit 211 iterates a series of processes by returning to step SP49 again to transport the remaining transaction banknotes.

On the other hand, when the positive result is obtained in step SP53, the deposit/withdrawal unit 12 is in a state in which only counterfeit notes having the same serial number among the transaction banknotes are transported to the counterfeit note storage compartment 19 and only the remaining normal transaction banknotes remain, that is, a state in which transaction banknotes of an amount of money which is less than a withdrawal amount by an amount of money for transaction banknotes which are counterfeit notes are stored. At this time, the banknote control unit 211 moves to the next step SP54.

The banknote control unit 211 causes banknotes based on the denominations and the number of banknotes corresponding to an amount of money insufficient for the withdrawal amount, that is, banknotes for replacing the banknotes stored in the counterfeit note storage compartment 19 as counterfeit notes because the serial number is the same, to be dispatched from the banknote storage compartment 16, causes the banknotes to be transported to the deposit/withdrawal unit 12 via the discrimination unit 14 by the transport unit 13 in step SP54, and returns to step SP44 again. Thereby, the banknote control unit 211 also causes the banknotes newly dispatched from the banknote storage compartment 16 to be collated with serial numbers of other transaction banknotes.

When the negative result is obtained in step SP47, this indicates that normal transaction banknotes based on the denominations and the number of banknotes corresponding to the withdrawal amount and to which different serial numbers are assigned are stored within the deposit/withdrawal unit 12. At this time, the banknote control unit 211 moves to the next step SP55 to open/close the shutter 12B of the deposit/withdrawal unit 12 and allow the user to extract the transaction banknotes as in step SP35, and moves to the next step SP56.

The banknote control unit 211 prepares for the next withdrawal transaction by deleting all transaction serial numbers stored in the storage unit 211M in step SP56 as in step SP36 (FIG. 6) and moves to the next step SP57 to end the withdrawal processing procedure RT3.

3-2. Operation and Effects

In the above configuration, the banknote deposit/withdrawal mechanism 210 of the ATM 201 according to the third embodiment reads serial numbers of all transaction banknotes by the discrimination unit 14, stores the read serial numbers as transaction serial numbers in the transaction serial number list L1, and causes the transaction serial number list L1 to be stored in the storage unit 211M. Further, the banknote deposit/withdrawal mechanism 210 confirms whether a banknote having the same serial number is among the transaction banknotes by comparing each transaction serial number with another transaction serial number by the banknote control unit 211.

Thereby, as in the first and second embodiments, when a plurality of transaction banknotes having the same serial number are included among transaction banknotes, the banknote deposit/withdrawal mechanism 210 can detect the plurality of transaction banknotes having the same serial number and determine that the transaction banknotes are counterfeit notes.

Also, when a plurality of banknotes having the same serial number are included among the transaction banknotes, the banknote deposit/withdrawal mechanism 210 causes only the transaction banknotes which are counterfeit notes having the same serial number to be transported to the counterfeit note storage compartment 19 and stored in the counterfeit note storage compartment 19 as the abnormality handling process. On the other hand, the other transaction banknotes remain in the deposit/withdrawal unit 12 and banknotes for an insufficient amount of money are dispatched from the banknote storage compartment 16 again. Thus, the banknote deposit/withdrawal mechanism 210 can finally provide the user with normal transaction banknotes based on the denominations and the number of banknotes corresponding to the withdrawal amount and which do not include a counterfeit note and it is unnecessary to cause the user to re-perform the withdrawal transaction as in the first and second embodiments.

Further, it is possible to utilize normal transaction banknotes as effectively as possible because the banknote deposit/withdrawal mechanism 210 causes transaction banknotes having the same serial number, that is, only the counterfeit notes, to be transported to and stored in the counterfeit note storage compartment 19 as in the second embodiment, while the other normal transaction banknotes remain in the deposit/withdrawal unit 12 and the other normal transaction banknotes are finally caused to be withdrawn.

Also, even when banknotes for an insufficient amount are dispatched from the banknote storage compartment 16, the banknote deposit/withdrawal mechanism 210 reads a serial number of the banknote and collates the read serial number with a serial number of another withdrawal banknote. Thus, for example, even when a large number of banknotes having the same serial number are stored in the banknote storage compartment 16, the banknote deposit/withdrawal mechanism 210 can detect the banknotes as counterfeit notes every time the banknote is dispatched and can store the counterfeit notes in the counterfeit note storage compartment 19 each time, so that it is possible to reliably prevent the counterfeit notes from being erroneously withdrawn by the user.

In other regards, the banknote deposit/withdrawal mechanism 210 according to the third embodiment can have operation and effects similar to those of the banknote deposit/withdrawal mechanism 10 according to the first embodiment.

According to the above configuration, the banknote deposit/withdrawal mechanism 210 of the ATM 201 according to the third embodiment confirms whether a banknote having the same serial number is among the transaction banknotes by comparing each transaction serial number obtained by reading the serial number of each transaction banknote with another transaction serial number. Thereby, when a plurality of counterfeit notes newly counterfeited and having the same serial number are included among the transaction banknotes, the banknote deposit/withdrawal mechanism 210 can determine that transaction banknotes are the counterfeit notes in the collation process between the transaction serial numbers, previously prevent the counterfeit notes from being transferred to the user by storing the counterfeit notes in the counterfeit note storage compartment 19, and dispense normal transaction banknotes for a withdrawal amount by supplementing other banknotes for an insufficient amount.

4. Fourth Embodiment

An ATM 301 (FIG. 1) according to the fourth embodiment is different from the ATM 1 according to the first embodiment in that a banknote deposit/withdrawal mechanism 310 is provided in place of the banknote deposit/withdrawal mechanism 10, and other elements are configured to be similar to those of the first embodiment. The banknote deposit/withdrawal mechanism 310 (FIGS. 2 and 3) is different from the banknote deposit/withdrawal mechanism 10 according to the first embodiment in that a banknote control unit 311 is provided in place of the banknote control unit 11, but other elements are configured to be similar to those of the first embodiment.

Similar to the banknote control unit 11 according to the first embodiment, the banknote control unit 311 is mainly constituted of a CPU (not illustrated) and performs various processes such as a deposit process and a withdrawal process by reading and executing a predetermined program. Also, the banknote control unit 311 has a storage unit 311M in place of the storage unit 11M. Similar to the storage unit 11M, the storage unit 311M stores various types of programs or various information such as discrimination information, but stores a withdrawal program partially different from those of the first to third embodiments.

The banknote deposit/withdrawal mechanism 310 executes a similar deposit process according to a deposit program similar to that of the first embodiment in the deposit transaction.

4-1. Withdrawal Process

Figure 8:
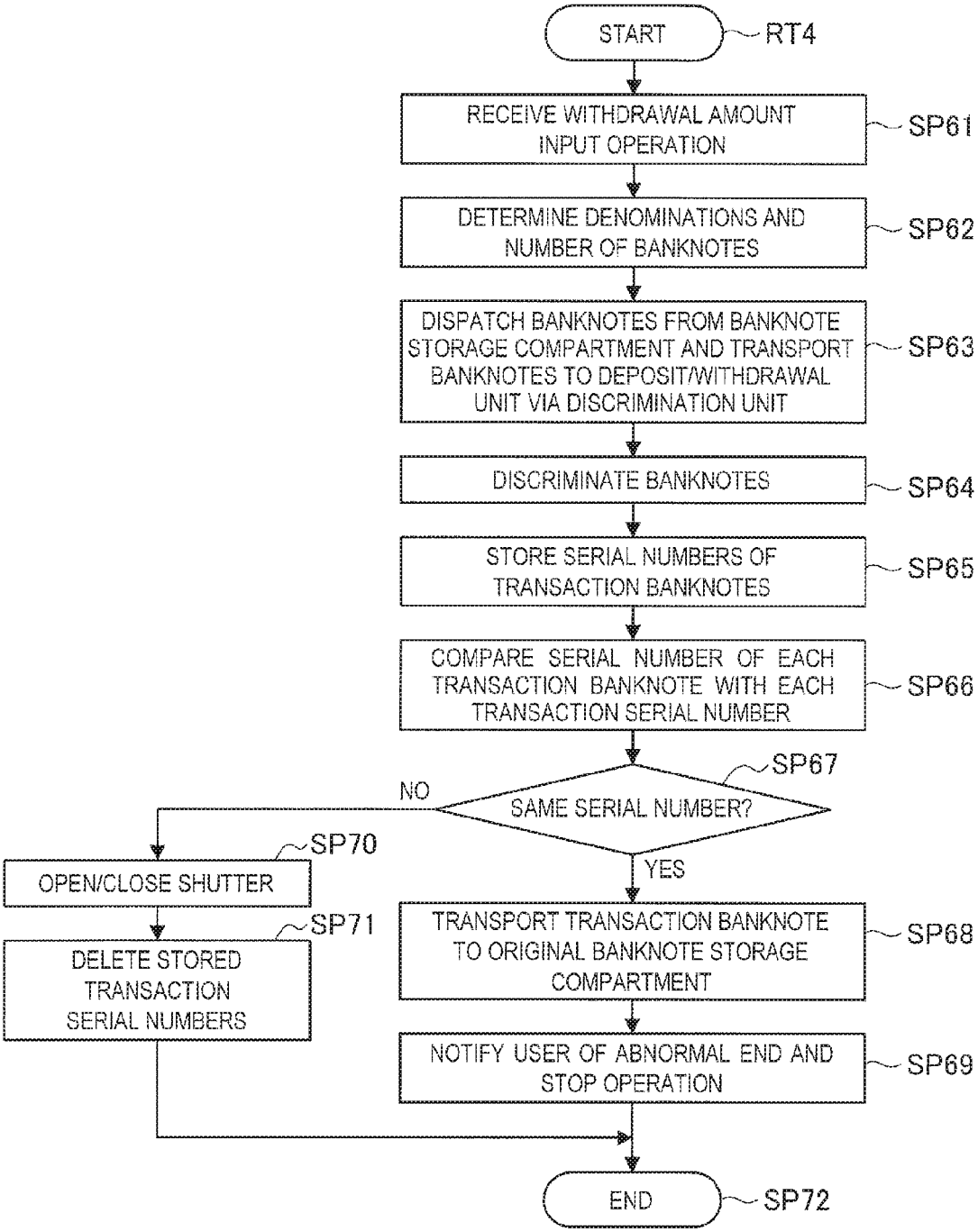
FIG. 8 is a flowchart illustrating a withdrawal processing procedure according to a fourth embodiment.

Next, a banknote withdrawal process in the banknote deposit/withdrawal mechanism 310 will be described. When the withdrawal transaction with the user is performed in the ATM 301, the banknote control unit 311 of the banknote deposit/withdrawal mechanism 310 starts a withdrawal processing procedure RT4 illustrated in FIG. 8 corresponding to FIG. 4 by reading the withdrawal program from the storage unit 311M to execute the read withdrawal program and moves to step SP61.

The banknote control unit 311 performs processes similar to those of steps SP1 to SP7 (FIG. 4) in step SP61 to SP67. When the positive result is obtained in step SP67, the banknote control unit 311 moves to the next step SP68.

The banknote control unit 311 causes all transaction banknotes contained in the deposit/withdrawal unit 12, that is, all banknotes including counterfeit notes, to be transported to and stored in the original banknote storage compartments 16 in step SP68, and moves to the next step SP69. Thereby, the banknote storage compartment 16 returns to a state before the withdrawal transaction is started.

The banknote control unit 311 notifies the user of the fact that the current withdrawal transaction is stopped and the operation of the ATM 301 is stopped because an abnormality has occurred in an internal process and the fact that the use of another ATM is requested by displaying a predetermined notification screen on the operation display unit 6 (FIG. 1), as in step SP9 (FIG. 4), in step SP69, and moves to the next step SP72 to end the withdrawal processing procedure RT4. In this case, the banknote control unit 311 retains the transaction serial numbers stored in the storage unit 311M without deleting the transaction serial numbers.

On the other hand, when the negative result is obtained in step SP67, this indicates that serial numbers of all the transaction banknotes are different from each other and no counterfeit note is included among the transaction banknotes. At this time, the banknote control unit 311 moves to the next step SP70 to open/close the shutter 12B of the deposit/withdrawal unit 12 and allow the user to extract the transaction banknote within the container 12A as in step SP10 (FIG. 4) and then moves to the next step SP71.

The banknote control unit 311 prepares for the next withdrawal transaction by deleting all transaction serial numbers stored in the storage unit 311M as in step SP11 (FIG. 4) in step SP71 and moves to the next step SP72 to end the withdrawal processing procedure RT4.

4-2. Operation and Effects

In the above configuration, the banknote deposit/withdrawal mechanism 310 of the ATM 301 according to the fourth embodiment reads serial numbers of all transaction banknotes by the discrimination unit 14, stores the read serial numbers as transaction serial numbers in the transaction serial number list L1, and causes the transaction serial number list L1 to be stored in the storage unit 311M. Further, the banknote deposit/withdrawal mechanism 310 confirms whether a banknote having the same serial number is among the transaction banknotes by comparing each transaction serial number with another transaction serial number by the banknote control unit 311.

Thereby, as in the first to third embodiments, when a plurality of transaction banknotes having the same serial number are included among transaction banknotes, the banknote deposit/withdrawal mechanism 310 can detect the plurality of transaction banknotes having the same serial number and determine that the transaction banknotes are counterfeit notes.

Also, when a plurality of banknotes having the same serial number are included among the transaction banknotes, the banknote deposit/withdrawal mechanism 310 causes all the transaction banknotes including the counterfeit note to be transported to and stored in the original banknote storage compartments 16 and stops the entire operation of the ATM 301 after notifying the user of the fact that an abnormality has occurred as the abnormality handling process.

Thereby, the banknote deposit/withdrawal mechanism 310 can previously prevent a banknote newly determined to be a counterfeit note having the same serial number from going into the hands of the user. In addition, a counterfeit note having the same serial number is likely to be further stored in the banknote storage compartment 16 storing the counterfeit note, but the banknote deposit/withdrawal mechanism 310 can previously prevent such a counterfeit note from going into the hands of the user.

Further, because the banknote deposit/withdrawal mechanism 310 can retain a state in which the counterfeit note is returned to the original banknote storage compartment 16, that is, a state in which the counterfeit note is stored before being dispatched from the banknote storage compartment 16, and stores the transaction serial number in the storage unit 311M, it is possible to cause an employee or maintenance worker of a financial institution or the like to examine the banknote storage compartment 16 in a state in which the counterfeit notes are stored.

In other regards, the banknote deposit/withdrawal mechanism 310 according to the fourth embodiment can have operation and effects similar to those of the banknote deposit/withdrawal mechanism 10 according to the first embodiment.

According to the above configuration, the banknote deposit/withdrawal mechanism 310 of the ATM 301 according to the fourth embodiment confirms whether a banknote having the same serial number is among the transaction banknotes by comparing each transaction serial number obtained by reading the serial number of each transaction banknote with another transaction serial number. Thereby, when a plurality of counterfeit notes newly counterfeited and having the same serial number are included among the transaction banknotes, the banknote deposit/withdrawal mechanism 310 can determine that transaction banknotes are the counterfeit notes in the collation process between the transaction serial numbers. The banknote deposit/withdrawal mechanism 310 can previously prevent the counterfeit note from being transferred to the user by stopping the operation in a state in which all the transaction banknotes are returned to the banknote storage compartment 16 and allow an employee of a financial institution or the like to easily examine a state in which the counterfeit note is stored in the banknote storage compartment 16.

5. Fifth Embodiment

An ATM 401 (FIG. 1) according to the fifth embodiment is different from the ATM 1 according to the first embodiment in that a banknote deposit/withdrawal mechanism 410 is provided in place of the banknote deposit/withdrawal mechanism 10, and other elements are configured to be similar to those of the first embodiment. The banknote deposit/withdrawal mechanism 410 (FIGS. 2 and 3) is different from the banknote deposit/withdrawal mechanism 10 according to the first embodiment in that a banknote control unit 411 is provided in place of the banknote control unit 11, but other elements are configured to be similar to those of the first embodiment.

Similar to the banknote control unit 11 according to the first embodiment, the banknote control unit 411 is mainly constituted of a CPU (not illustrated) and performs various processes such as a deposit process and a withdrawal process by reading and executing a predetermined program. Also, the banknote control unit 411 has a storage unit 411M in place of the storage unit 11M. Similar to the storage unit 11M, the storage unit 411M stores various types of programs or various information such as discrimination information, but stores a withdrawal program partially different from those of the first to fourth embodiments.

The banknote deposit/withdrawal mechanism 410 executes a similar deposit process according to a deposit program similar to that of the first embodiment in the deposit transaction.

5-1. Withdrawal Process

Figure 9:
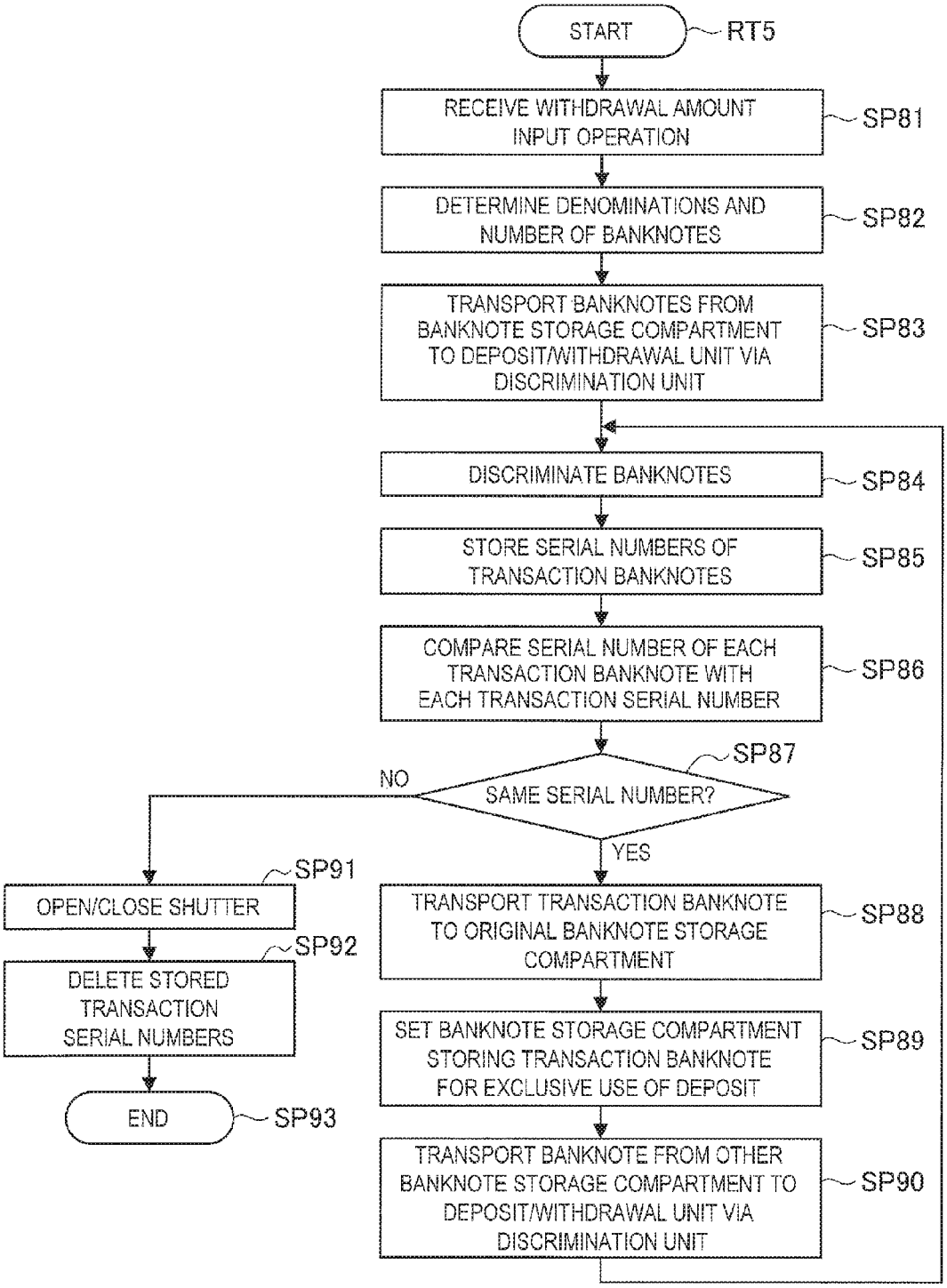
FIG. 9 is a flowchart illustrating a withdrawal processing procedure according to a fifth embodiment.

Next, a banknote withdrawal process in the banknote deposit/withdrawal mechanism 410 will be described. When the withdrawal transaction with the user is performed in the ATM 401, the banknote control unit 411 of the banknote deposit/withdrawal mechanism 410 starts a withdrawal processing procedure RT5 illustrated in FIG. 9 corresponding to FIGS. 4, 7, and 8 by reading the withdrawal program from the storage unit 411M to execute the withdrawal program and moves to step SP81.

The banknote control unit 411 performs processes similar to those of steps SP61 to SP68 (FIG. 8) in steps SP81 to SP88 and moves to the next step SP89. The banknote control unit 411 sets the banknote storage compartment 16 storing transaction banknotes, that is, the banknote storage compartment 16 storing counterfeit notes, for exclusive use of deposit in step SP89 and moves to the next step SP90.

In step SP90, the banknote control unit 411 sequentially dispatches banknotes based on the denominations and the number of banknotes determined in step SP62 from the banknote storage compartment 16 from which withdrawal is possible, that is, the banknote storage compartment 16 different from the banknote storage compartment 16 set for exclusive use of deposit in step SP89. In addition, the banknote control unit 411 also causes a banknote newly dispatched from the banknote storage compartment 16 to be collated with a serial number of another transaction banknote by causing the transport unit 13 to transport the banknote to the deposit/withdrawal unit 12 via the discrimination unit 14 and returning to step SP84 again.

On the other hand, when the negative result is obtained in step SP87, the banknote control unit 411 allows the user to extract transaction banknotes of a withdrawal amount by performing processes similar to those of steps SP55, SP56, and SP57 (FIG. 7) and ends the withdrawal processing procedure RT5 after deleting all transaction serial numbers stored in the storage unit 411M.

5-2. Operation and Effects

In the above configuration, the banknote deposit/withdrawal mechanism 410 of the ATM 401 according to the fifth embodiment reads serial numbers of all transaction banknotes by the discrimination unit 14, stores the read serial numbers as transaction serial numbers in the transaction serial number list L1, and causes the transaction serial number list L1 to be stored in the storage unit 411M. Further, the banknote deposit/withdrawal mechanism 410 confirms whether a banknote having the same serial number is among the transaction banknotes by comparing each transaction serial number with another transaction serial number by the banknote control unit 411.

Thereby, as in the first to fourth embodiments, when a plurality of transaction banknotes having the same serial number are included among transaction banknotes, the banknote deposit/withdrawal mechanism 410 can detect the plurality of transaction banknotes having the same serial number and determine that the transaction banknotes are counterfeit notes.

Also, when a plurality of banknotes having the same serial number are included among the transaction banknotes, the banknote deposit/withdrawal mechanism 410 causes all the transaction banknotes including the counterfeit note to be transported to and stored in the original banknote storage compartments 16, causes a new banknote to be dispatched from another banknote storage compartment 16 to designate the new banknote as the transaction banknote after setting the original banknote storage compartment for exclusive use of deposit, and iterates a series of processes as the abnormality handling process.

Thereby, the banknote deposit/withdrawal mechanism 410 can previously prevent a banknote newly determined to be a counterfeit note having the same serial number from going into the hands of the user. In addition, a counterfeit note having the same serial number is likely to be further stored in the banknote storage compartment 16 storing the counterfeit note, but the banknote deposit/withdrawal mechanism 410 can previously prevent such a counterfeit note from going into the hands of the user as in the fourth embodiment.

Further, because the banknote deposit/withdrawal mechanism 410 can retain a state in which the counterfeit note is stored before being dispatched from the banknote storage compartment 16 by returning the counterfeit note to the original banknote storage compartment 16 for exclusive use of deposit, it is possible to cause an employee or maintenance worker of a financial institution or the like to examine the banknote storage compartment 16 in a state in which the counterfeit notes are stored as in the fourth embodiment.

Also, the banknote deposit/withdrawal mechanism 410 can finally provide the user with normal transaction banknotes based on the denominations and the number of banknotes corresponding to the withdrawal amount and which does not include the counterfeit note as in the third embodiment by causing a new banknote to be dispatched from another banknote storage compartment 16 to designate the new banknote as a new transaction banknote and it is unnecessary to cause the user to re-perform the withdrawal transaction as in the first, second, and fourth embodiments.

In other regards, the banknote deposit/withdrawal mechanism 410 according to the fifth embodiment can have operation and effects similar to those of the banknote deposit/withdrawal mechanism 10 according to the first embodiment.

According to the above configuration, the banknote deposit/withdrawal mechanism 410 of the ATM 401 according to the fifth embodiment confirms whether a banknote having the same serial number is among the transaction banknotes by comparing each transaction serial number obtained by reading the serial number of each transaction banknote with another transaction serial number. Thereby, when a plurality of counterfeit notes newly counterfeited and having the same serial number are included among the transaction banknotes, the banknote deposit/withdrawal mechanism 410 can determine that transaction banknotes are the counterfeit notes in the collation process between the transaction serial numbers and dispense proper banknotes according to a withdrawal amount by continuing the operation while previously preventing a counterfeit note from being transferred to the user by returning all transaction banknotes to the banknote storage compartment 16 to set the banknote storage compartment 16 for exclusive use of deposit and re-dispatching banknotes from another banknote storage compartment 16.

6. Sixth Embodiment

An ATM 501 (FIG. 1) according to the sixth embodiment is different from the ATM 1 according to the first embodiment in that a banknote deposit/withdrawal mechanism 510 is provided in place of the banknote deposit/withdrawal mechanism 10, and other elements are configured to be similar to those of the first embodiment. The banknote deposit/withdrawal mechanism 510 (FIGS. 2 and 3) is different from the banknote deposit/withdrawal mechanism 10 according to the first embodiment in that a banknote control unit 511 is provided in place of the banknote control unit 11, but other elements are configured to be similar to those of the first embodiment.

Similar to the banknote control unit 11 according to the first embodiment, the banknote control unit 511 is mainly constituted of a CPU (not illustrated) and performs various processes such as a deposit process and a withdrawal process by reading and executing a predetermined program. Also, the banknote control unit 511 has a storage unit 511M in place of the storage unit 11M. Similar to the storage unit 11M, the storage unit 511M stores various types of programs or various information such as discrimination information, but stores a withdrawal program and a deposit program partially different from those of the first embodiment.

6-1. Transaction Serial Number List

In the sixth embodiment, four transaction serial number lists L2 (L2A to L2D) are stored in the storage unit 511M in correspondence with four banknote storage compartments 16 (16A to 16D) provided in the banknote deposit/withdrawal mechanism 510 (FIG. 2) as illustrated in FIG. 10 corresponding to FIG. 5 instead of the transaction serial number list L1.

Transaction serial numbers (that is, serial numbers of transaction banknotes) are stored in the transaction serial number list L2 similar to the transaction serial number list L1 (FIG. 5) according to the first embodiment. However, every time the withdrawal transaction is performed between the ATM 501 and the user, that is, every time the banknote deposit/withdrawal mechanism 510 performs the withdrawal process, the transaction serial number is added to the transaction serial number list L2 without being deleted. In other words, transaction serial numbers in current and previous transactions are stored in the transaction serial number list L2.

Also, when viewed from other viewpoints, serial numbers of banknotes currently having been dispatched from the banknote storage compartment 16 are recorded in the transaction serial number list L2. Thus, when banknotes having the same serial numbers as the recorded transaction serial numbers are dispatched thereafter, the banknotes having the same serial numbers are likely to be counterfeit notes.

No information indicating the denomination of each banknote is stored in the transaction serial number list L2. This is because the denomination of the banknote to be stored in each banknote storage compartment 16 is pre-allocated and all denominations of transaction banknotes having transaction serial numbers stored in one transaction serial number list L2 are the same.

Also, the banknote deposit/withdrawal mechanism 510 is provided with a predetermined sensor (not illustrated) at an installation position of each banknote storage compartment 16 in the housing. This sensor detects the detachment of the banknote storage compartment 16 from the housing, the attachment of the banknote storage compartment 16 to the housing, and the like and notifies the banknote control unit 511 of detection results.

When it is recognized that the banknote storage compartment 16 is detached from the housing on the basis of the notification from the sensor, the banknote control unit 511 initializes the transaction serial number list L2 associated with the banknote storage compartment 16 and deletes all the stored transaction serial numbers. That is, the banknote control unit 511 initializes the transaction serial number list L2 when the banknote dispatched once from the banknote storage compartment 16 is likely to be re-stored in the banknote storage compartment 16 through a distribution process.

Also, the banknote control unit 511 causes the discrimination unit 14 to discriminate all banknotes deposited by the user in the deposit transaction and also recognizes the serial number of each banknote on the basis of the obtained discrimination result. At this time, the banknote control unit 511 collates the serial number of the deposited banknote with a transaction serial number of the transaction serial number list L2 and deletes the transaction serial number from the transaction serial number list L2 when the serial numbers are the same. Thereby, only serial numbers of banknotes reliably dispatched from the banknote storage compartment 16 are stored in the transaction serial number list L2.

Thus, while the banknote control unit 511 causes the four transaction serial number lists L2 corresponding to the four banknote storage compartments 16 to be stored in the storage unit 511M and adds the transaction serial number every time a withdrawal transaction is performed, the deletion of the transaction serial numbers or the initialization of the transaction serial number list L2 is performed when the attachment/detachment of the banknote storage compartment 16 to/from the housing and the deposit transaction are performed.

6-2. Withdrawal Process

Figure 11:
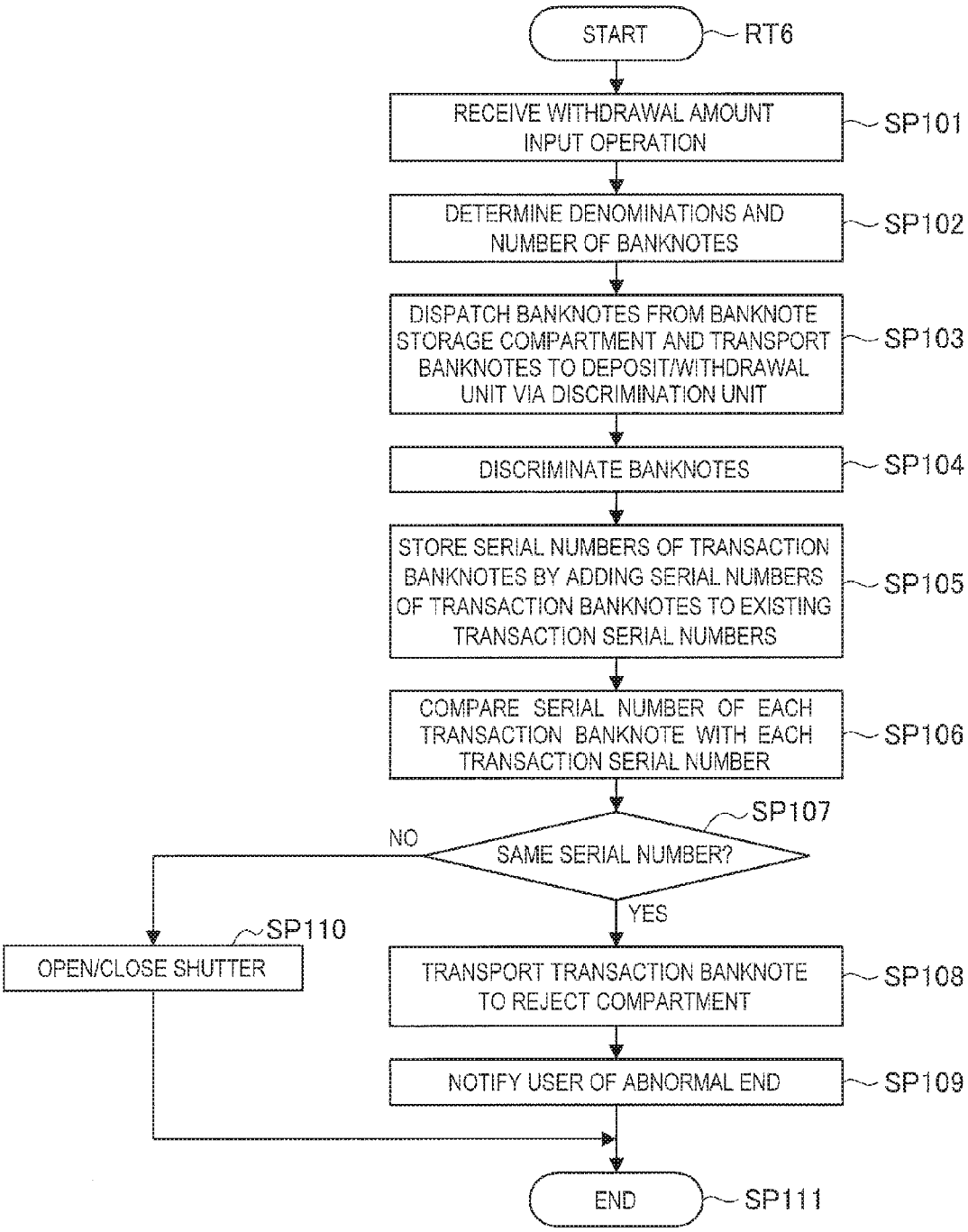
FIG. 11 is a flowchart illustrating a withdrawal processing procedure according to the sixth embodiment.

Next, a banknote withdrawal process in the banknote deposit/withdrawal mechanism 510 will be described. When the withdrawal transaction with the user is performed in the ATM 501, the banknote control unit 511 of the banknote deposit/withdrawal mechanism 510 starts a withdrawal processing procedure RT6 illustrated in FIG. 11 corresponding to FIG. 4 by reading the withdrawal program from the storage unit 511M to execute the read withdrawal program and moves to step SP101.

The banknote control unit 511 performs processes similar to steps SP1 to SP4 (FIG. 4) in steps SP101 to SP104, and moves to the next step SP105. In step SP105, the banknote control unit 511 adds and stores serial numbers of all transaction banknotes as transaction serial numbers in the transaction serial number list L2 (FIG. 10), causes the storage unit 511M to store the transaction serial number list L2, and moves to the next step SP106.

The banknote control unit 511 collates a serial number (that is, a transaction serial number) of each transaction banknote with all other transaction serial numbers stored in the transaction serial number list L2 by the collation unit 11C in step SP106 and moves to the next step SP107. Thereby, the banknote control unit 511 compares the serial number of each transaction banknote stored in the deposit/withdrawal unit 12 with each of the serial numbers of all banknotes having been dispatched from the same banknote storage compartment 16 and serial numbers of all other transaction banknotes currently stored in the deposit/withdrawal unit 12.

Thereafter, the banknote control unit 511 performs processes similar to steps SP7 to SP10 (FIG. 4) in steps SP107 to SP110 and moves to the next step SP111 to end the withdrawal processing procedure RT6. That is, because the banknote control unit 511 does not perform a process corresponding to step SP11 (FIG. 4) in the withdrawal processing procedure RT6, the transaction serial number stored in the transaction serial number list L2 of the storage unit 511M can be used in the collation process in the next and subsequent withdrawal transactions.

6-3. Operation and Effects

In the above configuration, the banknote deposit/withdrawal mechanism 510 of the ATM 501 according to the sixth embodiment reads serial numbers of all transaction banknotes by the discrimination unit 14, adds the read serial numbers as new transaction serial numbers to the transaction serial number list L2 (FIG. 10), and causes the transaction serial number list L2 to be stored in the storage unit 511M. Further, the banknote deposit/withdrawal mechanism 510 confirms whether a banknote having the same serial number is among banknotes having been dispatched from the banknote storage compartment 16 by comparing each transaction serial number with another transaction serial number by the banknote control unit 511.

Thereby, the banknote deposit/withdrawal mechanism 510 can determine whether the transaction banknote is a counterfeit note on the basis of whether the serial number of the transaction banknote is the same as another serial number in a range including previous transaction banknotes as well as current transaction banknotes, that is, in a range wider than those of the first to fifth embodiments.

For example, because the banknote deposit/withdrawal mechanism 510 can detect that a relevant banknote is a counterfeit note on the basis of the serial number even when a plurality of banknotes (that is, counterfeit notes) having the same serial number are stored in the banknote storage compartment 16 and dispatched to be divided into a plurality of withdrawal transactions, it is possible to increase the precision of detection of counterfeit notes more than in the first to fifth embodiments.

For example, when the banknote storage compartment 16 is detached from the housing and is filled with banknotes by an employee of the financial institution or the like in the banknote deposit/withdrawal mechanism 510, a banknote dispensed from the banknote storage compartment 16 in a previous withdrawal transaction and having a serial number stored in the transaction serial number list L2 may be incidentally re-filled in the banknote storage compartment 16 through a subsequent distribution process.

In this regard, the banknote deposit/withdrawal mechanism 510 deletes all transaction serial numbers by initializing the transaction serial number list L2 when the banknote storage compartment 16 is detached from the housing as the management of the transaction serial number list L2 stored in the storage unit 511M. Thereby, the banknote deposit/withdrawal mechanism 510 can previously prevent such a banknote from being erroneously determined to be a counterfeit note.

Also, the case in which the banknote deposit/withdrawal mechanism 510 dispenses, for example, banknotes in a withdrawal transaction with the user and the user continuously performs a deposit transaction such as a transfer using such banknotes may occur. In this case, the serial number of the transaction banknote dispatched from the banknote storage compartment 16 in the withdrawal transaction is stored as the transaction serial number in the transaction serial number list L2. Also, in the banknote deposit/withdrawal mechanism 510, banknotes deposited in the deposit transaction are stored in the banknote storage compartment 16, reused, and withdrawn in a subsequent withdrawal transaction. Then, because the serial number of the banknote re-withdrawn as the transaction banknote is the same as the transaction serial number stored in the transaction serial number list L2 in the banknote deposit/withdrawal mechanism 510, the banknote may be determined to be a counterfeit note in spite of the fact that it is a normal banknote.

In this regard, the banknote deposit/withdrawal mechanism 510 deletes a relevant transaction serial number from the transaction serial number list L2 when the serial number of the banknote deposited in the deposit transaction is the same as the transaction serial number stored in the transaction serial number list L2 as the management of the transaction serial number list L2 stored in the storage unit 511M. Thereby, the banknote deposit/withdrawal mechanism 510 can previously prevent such a banknote from being erroneously determined to be a counterfeit note even for the banknote deposited after the withdrawal and re-withdrawn.

In other regards, the banknote deposit/withdrawal mechanism 510 according to the sixth embodiment can have operation and effects similar to those of the banknote deposit/withdrawal mechanism 10 according to the first embodiment.

According to the above configuration, the banknote deposit/withdrawal mechanism 510 of the ATM 501 according to the sixth embodiment confirms whether a banknote having the same serial number is among the transaction banknotes by comparing each transaction serial number obtained by reading the serial number of each transaction banknote with transaction serial numbers which are serial numbers of banknotes having been dispatched from the banknote storage compartment 16. Thereby, the banknote deposit/withdrawal mechanism 510 can determine relevant banknotes as counterfeit notes when a plurality of counterfeit notes newly counterfeited and having the same serial number are included among current transaction banknotes or among previous transaction banknotes, and previously prevent the counterfeit notes from being transferred to the user by storing all transaction banknotes including the counterfeit note in the reject compartment 17.

7. Seventh Embodiment

An ATM 601 (FIG. 1) according to the seventh embodiment is different from the ATM 1 according to the first embodiment in that a banknote deposit/withdrawal mechanism 610 is provided in place of the banknote deposit/withdrawal mechanism 10, and other elements are configured to be similar to those of the first embodiment. The banknote deposit/withdrawal mechanism 610 (FIGS. 2 and 3) is different from the banknote deposit/withdrawal mechanism 10 according to the first embodiment in that a banknote control unit 611 is provided in place of the banknote control unit 11, but other elements are configured to be similar to those of the first embodiment.

Similar to the banknote control unit 11 according to the first embodiment, the banknote control unit 611 is mainly constituted of a CPU (not illustrated) and performs various processes such as a deposit process and a withdrawal process by reading and executing a predetermined program. Also, the banknote control unit 611 has a storage unit 611M in place of the storage unit 11M. Similar to the storage unit 11M, the storage unit 611M stores various types of programs or various information such as discrimination information, but stores a withdrawal program and a deposit program partially different from those of the first embodiment.

The banknote deposit/withdrawal mechanism 610 executes a similar withdrawal process according to a withdrawal program similar to that of the first embodiment in the withdrawal transaction.

7-1. Deposit Process

Figure 12:
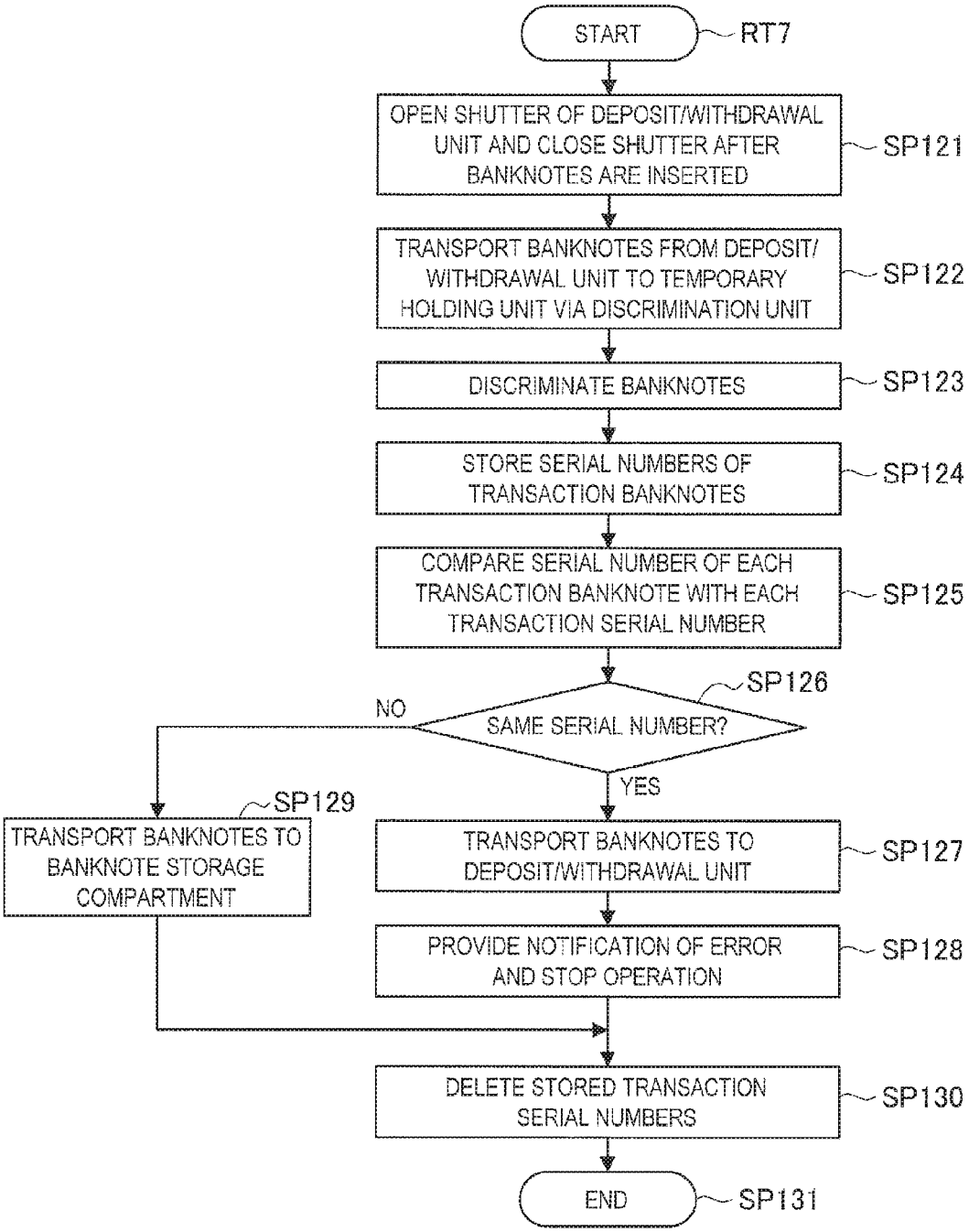
FIG. 12 is a flowchart illustrating a deposit processing procedure according to a seventh embodiment.

Next, a banknote deposit process in the banknote deposit/withdrawal mechanism 610 will be described. When a deposit transaction with the user is performed in the ATM 601, the banknote control unit 611 of the banknote deposit/withdrawal mechanism 610 starts a deposit processing procedure RT7 illustrated in FIG. 12 by reading the deposit program from the storage unit 611M to execute the read deposit program, and moves to step SP121.

In step SP121, the banknote control unit 611 allows the user to insert a banknote into the container 12A by opening the shutter 12B of the deposit/withdrawal unit 12. Further, when an input instruction for starting to read the banknote is received via the operation display unit 6 in conjunction with the main control unit 9 (FIG. 3), the banknote control unit 611 closes the shutter 12B and moves to the next step SP122. In this embodiment, the banknote inserted into the container 12A at this time is referred to as a transaction banknote.

The banknote control unit 611 causes the transaction banknote inserted into the container 12A of the deposit/withdrawal unit 12 to be transported to the temporary holding unit 15 via the discrimination unit 14 by the transport unit 13 in step SP122 and moves to the next step SP123. The banknote control unit 611 moves to the next step SP124 after causing banknotes currently being transported to be sequentially discriminated by the discrimination unit 14, acquiring discrimination results, and reading serial numbers of the discriminated banknotes in step SP123.

At this time, the banknote control unit 611 designates banknotes which are not determined to be normal like a plurality of banknotes transported in an overlapping state (that is, doubly fed) as deposit rejection banknotes, re-transports the deposit rejection banknotes to the deposit/withdrawal unit 12, and causes the banknotes to be returned to the user. Also, the banknote control unit 611 causes the banknotes determined to be counterfeit notes, that is, the banknotes having serial numbers matching the counterfeit note serial number list pre-stored by the banknote control unit 611, to be transported to the counterfeit note storage compartment 19.

The banknote control unit 611 stores serial numbers of all transaction banknotes as transaction serial numbers in the transaction serial number list L1 (FIG. 5) to cause the transaction serial number list L1 to be stored in the storage unit 611M as in step SP5 (FIG. 4) in step SP124 and moves to the next step SP125.

The banknote control unit 611 collates each transaction serial number with all the other transaction serial numbers stored in the transaction serial number list L1 by the collation unit 11C as in step SP6 (FIG. 4) in step SP125 and moves to the next step SP126. Thereby, the banknote control unit 611 also compares the serial number of each transaction banknote stored in the deposit/withdrawal unit 12 with each of the serial numbers of all the other transaction banknotes as in the first embodiment.

In step SP126, as in step SP7 (FIG. 4), the banknote control unit 611 determines whether the same serial number as another transaction serial number is among the transaction serial numbers, that is, whether banknotes having the same serial number as each other are included among the transaction banknotes.

When the positive result is obtained here, this indicates that, because the transaction banknote having the same serial number is a counterfeit note, the transaction banknote should not be reused in the next and subsequent withdrawal transactions and the transaction banknote should not be returned to the user from a viewpoint of early resolution or suppression of crime. At this time, the banknote control unit 11 moves to the next step SP127.

The banknote control unit 611 causes all transaction banknotes to be transported from the temporary holding unit 15 to the deposit/withdrawal unit 12 by the transport unit 13 in step SP127 and moves to the next step SP128. The banknote control unit 611 notifies an employee or a guard of a financial institution or the like of the fact that the transaction banknote is determined to be a counterfeit note by transmitting predetermined information via a communication processing unit (not illustrated) and stops the operation of the ATM 601, that is, all transaction processes, in conjunction with the main control unit 9 (FIG. 2) in step SP128 and moves to the next step SP130.

On the other hand, when the negative result is obtained in step SP126, this indicates that the serial numbers of all the transaction banknotes are different from each other and there is no possibility of a counterfeit note at least from a viewpoint of a serial number. At this time, the banknote control unit 611 moves to the next step SP129.

The banknote control unit 611 causes the banknotes to be transported to the denomination-specific banknote storage compartment 16 or the reject compartment 17 after causing the banknotes stored in the temporary holding unit 15 to be transported to the discrimination unit 14 one by one and re-discriminated and determining the denomination or a degree of damage on the basis of a discrimination result in step SP129 and moves to the next step SP130.

The banknote control unit 611 prepares for the next deposit transaction by deleting all transaction serial numbers stored in the storage unit 611M in a state in which the transaction serial numbers are stored in the transaction serial number list L1 (FIG. 5) as in step SP11 (FIG. 4) in step SP130 and moves to the next step SP131 to end the deposit processing procedure RT7.

7-2. Operation and Effects

In the above configuration, the banknote deposit/withdrawal mechanism 610 of the ATM 601 according to the seventh embodiment reads serial numbers of all transaction banknotes by the discrimination unit 14, stores the read serial numbers as transaction serial numbers in the transaction serial number list L1, and causes the transaction serial number list L1 to be stored in the storage unit 611M. Further, the banknote deposit/withdrawal mechanism 610 confirms whether a banknote having the same serial number is among the transaction banknotes by comparing each transaction serial number with another transaction serial number by the banknote control unit 611.

Thereby, even for a deposit transaction, when a plurality of transaction banknotes having the same serial number are included among transaction banknotes, the banknote deposit/withdrawal mechanism 610 can detect the plurality of transaction banknotes having the same serial number and determine that the transaction banknotes are counterfeit notes, as in the first embodiment.

Also, when a plurality of banknotes having the same serial number are included among the transaction banknotes, the banknote deposit/withdrawal mechanism 610 notifies an employee or a guard of a financial institution or the like of the fact that the plurality of banknotes having the same serial number are included among the transaction banknotes and immediately stops the operation of the ATM 601. Thereby, the banknote deposit/withdrawal mechanism 610 can contribute to the resolution or suppression of crime using the counterfeit notes by an employee or a guard of the financial institution requesting an explanation from the user.

Further, the banknote deposit/withdrawal mechanism 610 maintains a closed state of the shutter 12B after transporting all banknotes to the deposit/withdrawal unit 12 when a plurality of banknotes having the same serial number are included among the transaction banknotes. Thereby, the banknote deposit/withdrawal mechanism 610 can preserve transaction banknotes including a counterfeit note as evidence of crime without returning the transaction banknotes including the counterfeit note to the user and can cause the transaction banknotes to be immediately extracted by merely opening the shutter 12B according to an operation of the employee of the financial institution or the like.

Also, because the banknote deposit/withdrawal mechanism 610 mutually collates serial numbers of all transaction banknotes in one transaction process as in the first embodiment, it is possible to relatively reduce the number of serial numbers serving as collation targets and complete this collation process in a relatively short time.

Further, when the serial number of the deposited banknote matches the counterfeit note serial number list, the banknote deposit/withdrawal mechanism 610 clearly distinguishes the counterfeit note from other banknotes by previously determining the banknote as a counterfeit note to cause the counterfeit note to be stored in the counterfeit note storage compartment 19, and does not designate the counterfeit note as the transaction banknote. Thus, the banknote deposit/withdrawal mechanism 610 does not redundantly store the serial number of the banknote stored in the counterfeit note serial number list and previously determined to be the counterfeit note in the transaction serial number list L1 and does not perform a redundant collation process by the banknote control unit 611, as in the first embodiment.

According to the above configuration, the banknote deposit/withdrawal mechanism 610 of the ATM 601 according to the seventh embodiment confirms whether a banknote having the same serial number is among the transaction banknotes by comparing each transaction serial number obtained by reading the serial number of each transaction banknote with another transaction serial number. Thereby, when a plurality of counterfeit notes newly counterfeited and having the same serial number are included among the transaction banknotes, the banknote deposit/withdrawal mechanism 610 cannot determine the transaction banknotes as the counterfeit notes in the process of collating the serial numbers with the counterfeit note serial number list, but can determine that transaction banknotes are the counterfeit notes in the collation process between the transaction serial numbers and previously prevent the counterfeit notes from being reused and withdrawn by other users by stopping the operation of the ATM 601.

8. Eighth Embodiment

An ATM 701 (FIG. 1) according to the eighth embodiment is different from the ATM 601 according to the seventh embodiment in that a banknote deposit/withdrawal mechanism 710 is provided in place of the banknote deposit/withdrawal mechanism 610, and other elements are configured to be similar to those of the seventh embodiment. The banknote deposit/withdrawal mechanism 710 (FIGS. 2 and 3) is different from the banknote deposit/withdrawal mechanism 610 according to the seventh embodiment in that a banknote control unit 711 is provided in place of the banknote control unit 611, but other elements are configured to be similar to those of the seventh embodiment.

Similar to the banknote control unit 611 according to the seventh embodiment, the banknote control unit 711 is mainly constituted of a CPU (not illustrated) and performs various processes such as a deposit process and a withdrawal process by reading and executing a predetermined program. Also, the banknote control unit 711 has a storage unit 711M in place of the storage unit 611M. Similar to the storage unit 611M, the storage unit 711M stores various types of programs or various information such as discrimination information, but stores a withdrawal program and a deposit program partially different from those of the seventh embodiment.

8-1. Transaction Serial Number List

In the eighth embodiment, as in the sixth embodiment, four transaction serial number lists L2 (L2A to L2D) are stored in the storage unit 711M in correspondence with four banknote storage compartments 16 (16A to 16D) provided in the banknote deposit/withdrawal mechanism 710 (FIG. 2).

Transaction serial numbers (that is, serial numbers of transaction banknotes) in deposit transactions are stored in the transaction serial number list L2. Also, every time the deposit transaction is performed between the ATM 701 and the user, that is, every time the banknote deposit/withdrawal mechanism 710 performs the deposit process, the transaction serial number is added to the transaction serial number list L2 without being deleted. In other words, transaction serial numbers in current and previous transactions are stored in the transaction serial number list L2 as in the sixth embodiment.

Also, when viewed from other viewpoints, serial numbers of banknotes currently having been stored in the banknote storage compartment 16 are recorded in the transaction serial number list L2. Thus, when banknotes having the same serial numbers as the transaction serial numbers are stored thereafter, the banknote having the same serial number is likely to be a counterfeit note.

Also, similar to the banknote deposit/withdrawal mechanism 510 according to the sixth embodiment, the banknote deposit/withdrawal mechanism 710 is provided with a predetermined sensor (not illustrated) at an installation position of each banknote storage compartment 16 in the housing. This sensor detects the detachment of the banknote storage compartment 16 from the housing, the attachment of the banknote storage compartment 16 to the housing, and the like and notifies the banknote control unit 711 of detection results.

When it is recognized that the banknote storage compartment 16 is detached from the housing on the basis of the notification from the sensor, the banknote control unit 711 initializes the transaction serial number list L2 associated with the banknote storage compartment 16 and deletes all the stored transaction serial numbers. That is, the banknote control unit 711 initializes the transaction serial number list L2 when the banknote stored once in the banknote storage compartment 16 is extracted by an employee of a financial institution or the like and is likely to be re-stored in the banknote storage compartment 16 through a distribution process.

Also, the banknote control unit 711 causes the discrimination unit 14 to discriminate all banknotes to be withdrawn by the user in the withdrawal transaction and also recognizes the serial number of each banknote. At this time, the banknote control unit 711 collates the serial number of the withdrawn banknote with a transaction serial number stored in the transaction serial number list L2 and deletes the transaction serial number from the transaction serial number list L2 when the serial numbers are the same. Thereby, only serial numbers of banknotes reliably stored in the banknote storage compartment 16 are stored in the transaction serial number list L2.

Thus, while the banknote control unit 711 causes the four transaction serial number lists L2 corresponding to the four banknote storage compartments 16 to be stored in the storage unit 711M and adds the transaction serial number every time a deposit transaction is performed, the deletion of the transaction serial numbers or the initialization of the transaction serial number list L2 is performed when the attachment/detachment of the banknote storage compartment 16 to/from the housing and the withdrawal transaction are performed.

8-2. Deposit Process

Figure 13:
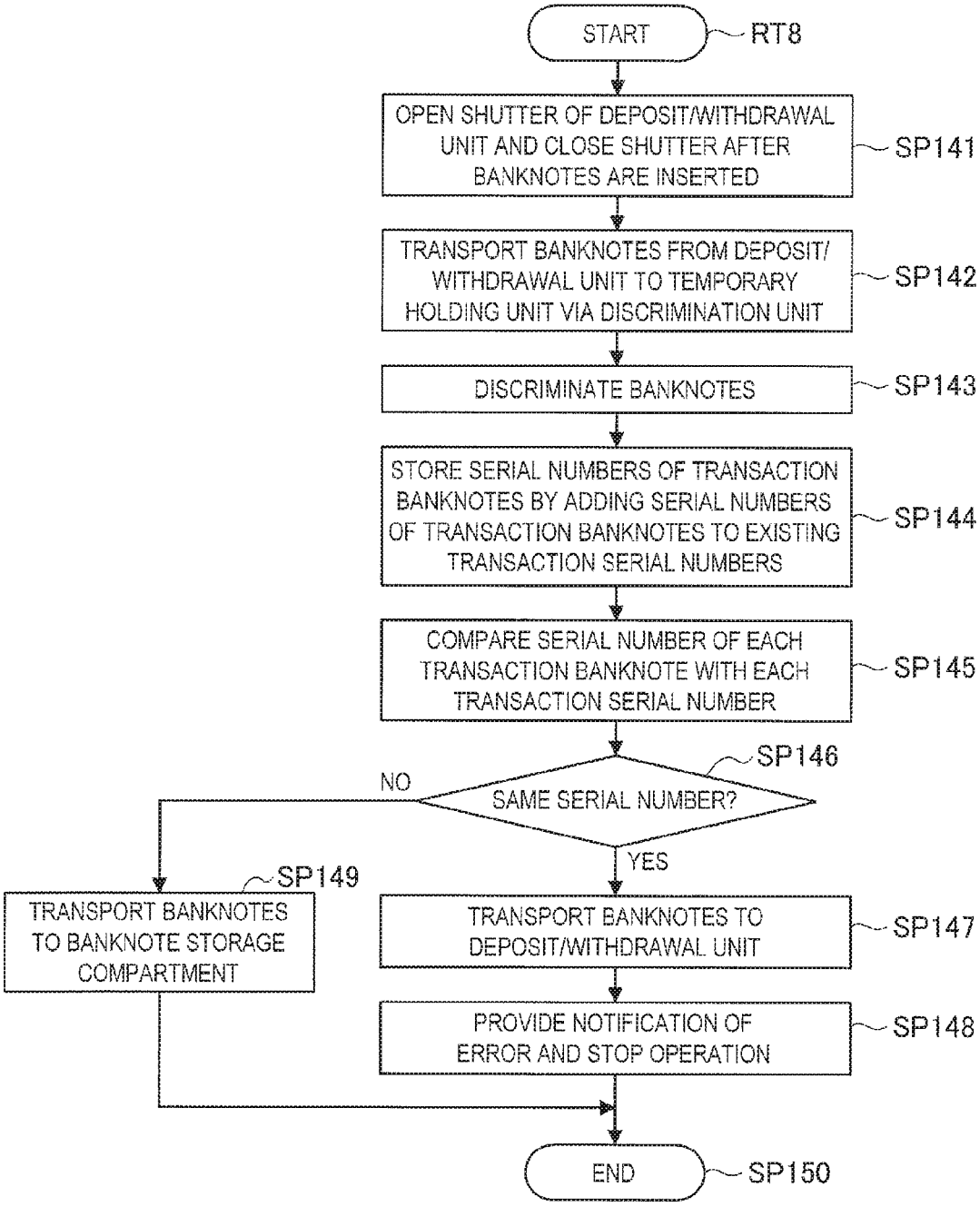
FIG. 13 is a flowchart illustrating a deposit processing procedure according to an eighth embodiment.

Next, a banknote deposit process in the banknote deposit/withdrawal mechanism 710 will be described. When a deposit transaction with the user is performed in the ATM 701, the banknote control unit 711 of the banknote deposit/withdrawal mechanism 710 starts a deposit processing procedure RT8 illustrated in FIG. 13 by reading the deposit program from the storage unit 711M to execute the read deposit program, and moves to step SP141.

The banknote control unit 711 performs processes similar to steps SP121 to SP123 (FIG. 12) in steps SP141 to SP143, and moves to the next step SP144. The banknote control unit 711 adds and stores serial numbers of all transaction banknotes as transaction serial numbers in the transaction serial number list L2 (FIG. 10) and causes the storage unit 711M to store the transaction serial number list L2 in step S144, and moves to the next step SP145.

The banknote control unit 711 collates each transaction serial number (that is, a serial number of each transaction banknote) with all other transaction serial numbers stored in the transaction serial number list L2 by the collation unit 11C in step SP145 and moves to the next step SP146. Thereby, the banknote control unit 711 compares a serial number of each transaction banknote stored in the temporary holding unit 15 with each of serial numbers of all banknotes having been stored in the banknote storage compartment 16 and serial numbers of all other transaction banknotes currently stored in the temporary holding unit 15.

Thereafter, the banknote control unit 711 performs processes similar to steps SP126 to SP129 (FIG. 12) in steps SP146 to SP149 and moves to the next step SP151 to end the deposit processing procedure RT8. That is, because the banknote control unit 711 does not perform a process corresponding to step SP130 (FIG. 12) in the deposit processing procedure RT8, the transaction serial number stored in the transaction number list L2 of the storage unit 711M can be used in the collation process in the next and subsequent deposit transactions.

8-3. Operation and Effects

In the above configuration, the banknote deposit/withdrawal mechanism 710 of the ATM 701 according to the eighth embodiment reads serial numbers of all transaction banknotes by the discrimination unit 14, adds the read serial numbers as new transaction serial numbers to the transaction serial number list L2 (FIG. 10), and causes the transaction serial number list L2 to be stored in the storage unit 711M. Further, the banknote deposit/withdrawal mechanism 710 confirms whether a banknote having the same serial number is among banknotes having been stored in the banknote storage compartment 16 by comparing each transaction serial number with another transaction serial number by the banknote control unit 711.

Thereby, the banknote deposit/withdrawal mechanism 710 can determine whether the transaction banknote is a counterfeit note on the basis of whether the serial number of the transaction banknote is the same as another serial number in a range including previous transaction banknotes as well as current transaction banknotes, that is, in a range wider than that of the seventh embodiment.

That is, because the banknote deposit/withdrawal mechanism 710 can detect whether a relevant banknote is a counterfeit note on the basis of a collation result between serial numbers even when banknotes (that is, counterfeit notes) having the same serial number are inserted to be divided into a plurality of deposit transactions, it is possible to increase the precision of detection of counterfeit notes more than in the seventh embodiment.

Also, the banknote deposit/withdrawal mechanism 710 deletes all transaction serial numbers by initializing the transaction serial number list L2 when the banknote storage compartment 16 is detached from the housing as the management of the transaction serial number list L2 stored in the storage unit 711M as in the sixth embodiment. Thereby, the banknote deposit/withdrawal mechanism 710 can previously prevent such a banknote from being erroneously determined to be a counterfeit note when a banknote deposited in a previous deposit transaction is re-deposited through a distribution process.

Further, the banknote deposit/withdrawal mechanism 710 deletes a relevant transaction serial number from the transaction serial number list L2 when the serial number of the banknote withdrawn in the withdrawal transaction is the same as the transaction serial number stored in the transaction serial number list L2 as the management of the transaction serial number list L2 stored in the storage unit 711M. Thereby, the banknote deposit/withdrawal mechanism 710 can previously prevent such a banknote from being erroneously determined to be a counterfeit note even for the banknote withdrawn after the deposit and re-deposited.

In other regards, the banknote deposit/withdrawal mechanism 710 according to the eighth embodiment can have operation and effects similar to those of the banknote deposit/withdrawal mechanism 610 according to the seventh embodiment.

According to the above configuration, the banknote deposit/withdrawal mechanism 710 of the ATM 701 according to the eighth embodiment confirms whether a banknote having the same serial number is among the transaction banknotes by comparing each transaction serial number obtained by reading the serial number of each transaction banknote with transaction serial numbers which are serial numbers of banknotes having been stored in the banknote storage compartment 16. Thereby, when a plurality of counterfeit notes newly counterfeited and having the same serial number are included among current transaction banknotes or among previous transaction banknotes, the banknote deposit/withdrawal mechanism 710 can determine that transaction banknotes are the counterfeit notes and previously prevent the counterfeit notes from being reused and withdrawn by other users by stopping the operation of the ATM 701.

9. Other Embodiments

Also, the cases in which serial numbers are collated using all transaction banknotes in the current withdrawal transaction or deposit transaction as a target in the above-described first to fifth and seventh embodiments, using current transaction banknotes and transaction banknotes previously dispatched from the banknote storage compartment 16 as a target in the sixth embodiment, and using current transaction banknotes and transaction banknotes previously stored in the banknote storage compartment 16 as a target in the eighth embodiment have been described.

However, the present invention is not limited thereto, and serial numbers may be collated using transaction banknotes of various ranges as a target such as using all transaction banknotes in five previous withdrawal or deposit transactions as a target or using the last 500 transaction banknotes in a withdrawal transaction or deposit transaction as a target, for example, in consideration of a time required for the collation process. In this case, a range including at least all current transaction banknotes is desirable.

Also, the case in which all transaction banknotes are transported to the reject compartment 17 as the abnormality handling process when a banknote having the same serial number is included among the transaction banknotes has been described in the above-described first embodiment. However, the present invention is not limited thereto. As the abnormality handling process, banknotes may be stored in various other storage compartments, for example, such as the counterfeit note storage compartment 19 and one banknote storage compartment 16 pre-allocated for exclusive use. In short, it is only necessary to store the banknotes in a state in which the transaction banknotes and normal banknotes can be clearly distinguished. The same is true for storage positions of banknotes (that is, counterfeit notes) of the same serial number in the second and third embodiments. Further, as in the seventh embodiment, the operation of the ATM 1 may be stopped after transporting all transaction banknotes to the deposit/withdrawal unit 12. The same is true for the second to sixth embodiments.

Further, the case in which a serial number which is the same as that of the counterfeit note serial number list is not stored in the transaction serial number list L1 by performing a process of determining a counterfeit note using a counterfeit note serial number list and storing the transaction serial number in the transaction serial number list L1 after the counterfeit note is excluded from the transaction banknotes has been described in the above-described first embodiment. However, the present invention is not limited thereto, and, for example, even when the transaction serial number is registered in the counterfeit note serial number list, the collation process may be configured to be performed after intentionally storing the transaction serial number (that is, a serial number of a banknote determined to be a counterfeit note) in the transaction serial number list L1. In this case, it is possible to more reliably determine the counterfeit note. The same is true for the second to eighth embodiments.

Further, the case in which a withdrawal transaction ends without providing banknotes and the user is caused to restart a withdrawal transaction procedure from the beginning when a banknote having the same serial number is included among transaction banknotes has been described in the above-described first embodiment. However, the present invention is not limited thereto, and, for example, banknotes of a withdrawal amount may be finally dispensed by re-dispatching the banknotes of the withdrawal amount from the banknote storage compartment 16 and iterating a similar process after all transaction banknotes are transported to the reject compartment 17 when a banknote having the same serial number is included among transaction banknotes. The same is true for the second embodiment.

Further, the case in which the collation process is performed on transaction serial numbers of the transaction serial number list L2 (for example, L2A) associated with the banknote storage compartment 16 (for example, 16A) from which the banknotes are dispatched has been described in the above-described sixth embodiment. However, the present invention is not limited thereto, and, for example, the collation process may be performed by adding transaction serial numbers of a transaction serial number list L2B associated with another banknote storage compartment 16B storing banknotes having the same denomination as the transaction banknote to the target. The same is true for the eighth embodiment.

Further, the case in which all transaction banknotes are stored in the reject compartment 17 as in the first embodiment as the abnormality handling process when a banknote having the same serial number is included among transaction banknotes has been described in the above-described sixth embodiment. However, the present invention is not limited thereto, and, as the abnormality handling process, only transaction banknotes having the same serial number may be transported to the counterfeit note storage compartment 19 and other transaction banknotes may be returned to the banknote storage compartment 16, for example, as in the second embodiment, or transaction banknotes of a withdrawal amount may be finally withdrawn by the user by additionally dispatching banknotes of an insufficient amount for the withdrawal amount from the banknote storage compartment 16 as in the third embodiment.

Further, the case in which serial numbers of banknotes dispatched from each banknote storage compartment 16 are stored in the transaction serial number list L2 has been described in the above-described sixth embodiment and the case in which serial numbers of banknotes stored in each banknote storage compartment 16 are stored in the transaction serial number list L2 has been described in the eighth embodiment. However, the present invention is not limited thereto, and, for example, the sixth and eighth embodiments may be combined. In this case, it is only necessary to independently prepare a dispatch transaction serial number list L2 for storing serial numbers of dispatched banknotes and a storage transaction serial number list L2 for storing serial numbers of stored banknotes.

Further, the case in which all transaction banknotes are transported to the deposit/withdrawal unit 12 as the abnormality handling process when a banknote having the same serial number is included among transaction banknotes has been described in the above-described seventh embodiment. However, the present invention is not limited thereto, and, as the abnormality handling process, for example, as in the first embodiment, all transaction banknotes may be transported to various positions such as the reject compartment 17 and the counterfeit note storage compartment 19. The same is true for the eighth embodiment.

Further, the case in which the operation of the ATM 601 is stopped after transporting all transaction banknotes to the deposit/withdrawal unit 12 as the abnormality handling process when a banknote having the same serial number is included among transaction banknotes has been described in the above-described seventh embodiment. However, the present invention is not limited thereto. As the abnormality handling process, the operation may be continued after transporting all transaction banknotes to the reject compartment 17, for example, as in the first embodiment, or banknotes (that is, counterfeit notes) having the same serial number may be stored in the counterfeit note storage compartment 19 and other normal banknotes may be transported to and stored in the denomination-specific banknote storage compartment 16 as in the second embodiment. The same is true for the eighth embodiment.

Further, the case in which it is confirmed whether a transaction banknote having the same serial number is among the transaction banknotes dispatched from the banknote storage compartment 16 and transported to the deposit/withdrawal unit 12 in a withdrawal transaction has been described in the above-described first embodiment. However, the present invention is not limited thereto, and, for example, when the user has left without extracting a banknote from the deposit/withdrawal unit 12, that is, when forgetting to take the banknote has occurred, it may be confirmed whether a banknote having the same serial number is among banknotes that the user has forgotten to take. The same is true for the second to eighth embodiments.

Further, the case in which both a withdrawal transaction and a deposit transaction are performed in the ATM 1 has been described in the above-described first embodiment. However, the present invention is not limited thereto, and only the withdrawal transaction may be performed without performing the deposit transaction in the ATM 1. The same is true for the second to sixth embodiments. In particular, it is unnecessary to delete serial numbers of deposited banknotes from the transaction serial number list L2 when no deposit transaction is performed in the sixth embodiment.

Further, the case in which both a withdrawal transaction and a deposit transaction are performed in the ATM 601 has been described in the above-described seventh embodiment. However, the present invention is not limited thereto, and, for example, only the deposit transaction may be performed without performing a withdrawal transaction in the ATM 601. The same is true for the eighth embodiment and it is unnecessary to delete serial numbers of withdrawn banknotes from the transaction serial number list L2 when no withdrawal transaction is performed.

Further, the case in which information indicating the denomination is stored together with serial numbers in the transaction serial number list L1 has been described in the above-described first embodiment (FIG. 5). However, the present invention is not limited thereto, and, for example, when a system of serial numbers differs according to each denomination or when information indicating the denomination is included in a part of the serial number, it is unnecessary to store the information indicating the denomination. The same is true for the second to fifth and seventh embodiments.

Further, the present invention is not limited to the above-described embodiments and other embodiments. That is, the present invention is also applicable to an embodiment in which some or all of the above-described embodiments and the above-described other embodiments are optionally combined or an embodiment from which a part is extracted.

Further, the case in which the banknote control unit 11 of the banknote deposit/withdrawal mechanism 10 executes the withdrawal process has been described in the above-described first embodiment. However, the present invention is not limited thereto, and, for example, the main control unit 9 may independently execute the withdrawal process or the main control unit 9 and the banknote control unit 11 may execute the withdrawal process cooperatively. In this case, the transaction serial number list L1 may be stored in the storage unit 9M of the main control unit 9 as well as the storage unit 11M of the banknote control unit 11. The same is true for the second to eighth embodiments.

Further, the case in which the withdrawal program is pre-stored in the storage unit 11M of the banknote control unit 11 has been described in the above-described first embodiment. However, the present invention is not limited thereto, and, for example, the withdrawal program may be stored in the storage unit 9M of the main control unit 9, acquired by downloading the withdrawal program from a server when the server or the like is connected via a network (not illustrated), or acquired by reading the withdrawal program from a removable storage means such as a Universal Serial Bus (USB) via an interface (not illustrated). The same is true for the second to eighth embodiments.

Further, the case in which the present invention is applied to the ATM 1 for transacting a banknote serving as a medium between the ATM 1 and the user has been described in the above-described first embodiment. However, the present invention is not limited thereto, and may be applied to, for example, a device (so-called teller machine) for performing a banknote deposit or withdrawal process installed in a financial institution's counter, a currency exchange machine, a vending machine, and various devices for exchanging media, such as various types of vouchers and securities, to which a unique identification number is assigned with a user. The same is true for the second to eighth embodiments.

Further, the case in which the banknote deposit/withdrawal mechanism 10 serving as the medium transaction device is constituted of the discrimination unit 14 and the banknote control unit 11 serving as a read unit, the banknote control unit 11 serving as a comparison unit, and the transport unit 13 and the reject compartment 17 serving as an abnormality handling unit has been described in the above-described embodiments. However, the present invention is not limited thereto, and the medium transaction device may be constituted of the read unit, the comparison unit, and the abnormality handling unit in various other configurations.

INDUSTRIAL APPLICABILITY

The present invention can also be applied to various devices for exchanging media, such as banknotes, having unique serial numbers with a user.

REFERENCE SIGNS LIST

1, 101, 201, 301, 401, 501, 601, 701 ATM
6 operation display unit
9 main control unit
9C collation unit
9M storage unit
10, 110, 210, 310, 410, 510, 610, 710 banknote deposit/withdrawal mechanism
11, 111, 211, 311, 411, 511, 611, 711 banknote control unit
11M, 111M, 211M, 311M, 411M, 511M, 611M, 711M storage unit
12 deposit/withdrawal unit
13 transport unit
14 discrimination unit
15 temporary holding unit
16 banknote storage compartment
17 reject compartment
18 untaken banknote storage compartment
19 counterfeit note storage compartment
L1, L2 transaction serial number list

The invention claimed is:

1. A medium transaction device that receives and dispenses transaction media, each transaction medium having an identification number, comprising:

a read unit configured to read each identification number from each transaction medium to be transacted between a user and the medium transaction device in a current transaction;

a comparison unit configured to compare each of the identification numbers read by the read unit in the current transaction; and an abnormality handling unit configured to perform a predetermined abnormality handling process when the identification numbers of at least two of the transaction media are identified as being the same by the comparison unit.

2. The medium transaction device according to claim 1, wherein the comparison unit further includes a storage unit configured to store the identification number in the current transaction, and a collation unit configured to collate each identification number in the current transaction with all other identification numbers stored in the storage unit.

3. The medium transaction device according to claim 1, further comprising:

a storage compartment configured to store and dispatch the media, wherein the read unit reads the identification number from the transaction medium to be dispatched from the storage compartment and transferred to the user.

4. The medium transaction device according to claim 3, wherein the comparison unit further includes a storage unit configured to store the identification numbers in current and previous transactions, and a collation unit configured to collate each identification number in the current transaction with all other identification numbers stored in the storage unit.

5. The medium transaction device according to claim 4, wherein the storage compartment is removable from the medium transaction device, and wherein the storage unit stores the identification number of the transaction medium dispatched from the storage compartment after the storage compartment is finally attached to the medium transaction device.

6. The medium transaction device according to claim 4, wherein the read unit reads the identification number from the transaction medium transferred from the user, wherein the storage compartment stores the transaction medium transferred from the user, and wherein the storage unit deletes the same identification number when the identification number read by the read unit from the transaction medium transferred from the user is the same as the identification number stored in the storage unit.

7. The medium transaction device according to claim 1, wherein the read unit reads the identification number from the transaction medium to be received from the user.

8. The medium transaction device according to claim 7, wherein the comparison unit further includes a storage unit configured to store the identification numbers in current and previous transactions, and a collation unit configured to collate each identification number in the current transaction with all other identification numbers stored in the storage unit.

9. The medium transaction device according to claim 8, further comprising:

a storage compartment configured to store the media and to be removable from the medium transaction device, wherein the storage unit stores the identification number of the transaction medium received from the user after the storage compartment is finally attached to the medium transaction device.

10. The medium transaction device according to claim 8, further comprising:

a storage compartment configured to store the media and dispatch the media to be transferred to the user and to be removable from the medium transaction device, wherein the read unit reads the identification number from the medium to be transferred to the user, and wherein the storage unit deletes the same identification number when the identification number read by the read unit from the medium to be transferred to the user is the same as the identification number stored in the storage unit.

11. The medium transaction device according to claim 1, further comprising:

an abnormal identification number storage unit configured to pre-store an abnormal identification number which is the identification number assigned to a counterfeit medium; and an abnormal medium exclusion unit configured to exclude the counterfeit medium, which has the abnormal identification number, from the transaction media, wherein the comparison unit compares each of the identification numbers, other than the abnormal identification number, read by the read unit in the current transaction.

12. The medium transaction device according to claim 1, wherein the abnormality handling unit performs the abnormality handling process on all the transaction media when the identification numbers of at least two of the transaction media are identified as being the same by the comparison unit.

13. The medium transaction device according to claim 12, wherein the abnormality handling unit stops reception of a new transaction when the identification numbers of at least two of the transaction media are identified as being the same by the comparison unit.

14. The medium transaction device according to claim 13, further comprising:

a transfer unit including a container configured to contain the medium to be transferred between the user and the medium transaction device and a shutter configured to close or open the container, wherein the abnormality handling unit causes the container of the transfer unit to contain all the transaction media and closes the shutter when the identification numbers of at least two of the transaction media are identified as being the same by the comparison unit.

15. The medium transaction device according to claim 13, further comprising:

a storage compartment configured to store and dispatch the media, wherein the read unit reads the identification number from the transaction medium to be dispatched from the storage compartment and transferred to the user, and wherein the abnormality handling unit causes all the transaction media to be stored in the original storage compartment when the identification numbers of at least two of the transaction media are identified as being the same by the comparison unit.

16. The medium transaction device according to claim 12, further comprising:

a plurality of storage compartments configured to store and dispatch the media, wherein the read unit reads the identification number from the transaction medium to be dispatched from the storage compartment and transferred to the user, and wherein, when the identification numbers of at least two of the transaction media are identified as being the same by the comparison unit, the abnormality handling unit causes all the transaction media to be returned to and stored in the original storage compartment, sets the storage compartment for exclusive use of storage, and causes the transaction medium to be transferred to the user to be dispatched from another storage compartment.

17. The medium transaction device according to claim 12, further comprising:

a distinguished medium storage compartment configured to store some media distinguished from the other media, wherein the abnormality handling unit causes all the transaction media to be stored in the distinguished medium storage compartment when the identification numbers of at least two of the transaction media are identified as being the same by the comparison unit.

18. The medium transaction device according to claim 12, further comprising:

a medium storage compartment configured to store the media; and a distinguished medium storage compartment configured to store some media distinguished from the other media, wherein, when the identification numbers of at least two of the transaction media are identified as being the same by the comparison unit, the abnormality handling unit causes the transaction medium having the same identification number to be stored in the distinguished medium storage compartment and causes the other transaction medium to be stored in the medium storage compartment.

19. The medium transaction device according to claim 1, wherein the abnormality handling unit performs the abnormality handling process on the transaction medium having the same identification number when the identification numbers of at least two of the transaction media are identified as being the same by the comparison unit.

20. The medium transaction device according to claim 19, further comprising:

a storage compartment configured to store and dispatch the media; and a distinguished medium storage compartment configured to store some media distinguished from the other media, wherein, when the identification numbers of at least two of the transaction mediums are identified as being the same by the comparison unit, the abnormality handling unit causes the transaction medium having the same identification number to be stored in the distinguished medium storage compartment, dispatches a new medium with which the transaction medium stored in the distinguished medium storage compartment is replaced from the storage compartment, and adds the new medium to the transaction medium.

* * * * *